US007504775B2

(12) United States Patent
Song et al.

(10) Patent No.: US 7,504,775 B2
(45) Date of Patent: Mar. 17, 2009

(54) PLASMA DISPLAY PANEL (PDP)

(75) Inventors: Su-Bin Song, Suwon-si (KR); Kyoung-Doo Kang, Suwon-si (KR); Jun-Yong Park, Suwon-si (KR); Won-Ju Yi, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 574 days.

(21) Appl. No.: 11/117,554

(22) Filed: Apr. 29, 2005

(65) Prior Publication Data

US 2005/0258747 A1 Nov. 24, 2005

(30) Foreign Application Priority Data

May 21, 2004 (KR) ..... 10-2004-0036392

(51) Int. Cl.
*H01J 17/49* (2006.01)

(52) U.S. Cl. ..... 313/584; 313/582; 313/585; 313/586; 313/587; 313/491; 313/621; 313/631

(58) Field of Classification Search ..... 313/582–587
See application file for complete search history.

(56) References Cited

U.S. PATENT DOCUMENTS 5,371,437 A * 12/1994 Amano ..... 315/169.1

(Continued)

FOREIGN PATENT DOCUMENTS

JP 02-148645 6/1990

JP 2845183 10/1998

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Nimeshkumar D. Patel
*Assistant Examiner*—Thomas A Hollweg
(74) *Attorney, Agent, or Firm*—Robert E. Bushnell, Esq.

(57) ABSTRACT

A Plasma Display Panel (PDP) has a high aperture ratio of a discharge cell, a high light transmittance, and a high luminous efficiency and a stable and efficient discharge occurs uniformly at a low driving voltage on inner sidewalls of the discharge cell and concentrates in the center of the discharge cell. The PDP includes: a front substrate and a rear substrate facing each other and separated from each other; barrier ribs of a dielectric material arranged between the front substrate and the rear substrate to define discharge cells together with the front substrate and the rear substrate; discharge electrodes arranged within the barrier ribs, the discharge electrodes being separated from each other and surrounding the discharge cells and having at least one corner portion for surrounding the discharge cells; fluorescent layers arranged in the discharge cells; a discharge gas contained within the discharge cells; and an attenuator adapted to reduce a strength of an electric field generated between at least one pair of corner portions of the discharge electrodes, the corner portions facing each other, to be less than a strength of an electric field generated between portions of the discharge electrodes facing each other, other than the corner portions, in the discharge cells.

12 Claims, 27 Drawing Sheets

U.S. PATENT DOCUMENTS

| | | | | |
|---|---|---|---|---|
| 5,541,618 | A | | 7/1996 | Shinoda |
| 5,661,500 | A | | 8/1997 | Shinoda et al. |
| 5,663,741 | A | | 9/1997 | Kanazawa |
| 5,674,553 | A | | 10/1997 | Shinoda et al. |
| 5,724,054 | A | | 3/1998 | Shinoda |
| 5,744,909 | A | * | 4/1998 | Amano ..... 313/585 |
| 5,786,794 | A | | 7/1998 | Kishi et al. |
| 5,952,782 | A | | 9/1999 | Nanto |
| RE37,444 | E | | 11/2001 | Kanazawa |
| 6,630,916 | B1 | | 10/2003 | Shinoda |
| 6,707,436 | B2 | | 3/2004 | Setoguchi et al. |
| 2005/0225242 | A1 | * | 10/2005 | Woo et al. ..... 313/582 |

FOREIGN PATENT DOCUMENTS

| | | |
|---|---|---|
| JP | 2917279 | 4/1999 |
| JP | 2001-043804 | 2/2001 |
| JP | 2001-325888 | 11/2001 |

* cited by examiner

PLASMA DISPLAY PANEL (PDP)

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 21 May 2004 and there duly assigned Serial No. 10-2004-0036392.

BACKGROUND OF THE INVENTION

1. Field of the Invention

The present invention relates to a Plasma Display Panel (PDP), and more particularly, to a PDP having a high aperture ratio of a discharge cell, a high light transmittance, and a high luminous efficiency and in which a stable and efficient discharge occurs uniformly at a low driving voltage on inner sidewalls of the discharge cell and concentrates in the center of the discharge cell.

2. Description of the Related Art

In an AC, triode-type, surface discharge PDP, the PDP comprises a front panel and a rear panel. The front panel comprises a front substrate, pairs of sustain electrodes composed of Y electrodes and X electrodes on a rear surface of the front substrate, a front dielectric layer covering the sustain electrodes, and a protective layer covering the front dielectric layer. Each of the Y electrodes is composed of a transparent electrode and a bus electrode, and each of the X electrodes is composed of a transparent electrode and a bus electrode. The transparent electrodes are made of Indium Tin Oxide (ITO) or the like. The bus electrodes are connected to connection cables (not shown) disposed at right and left sides of the PDP.

The rear panel comprises a rear substrate, address electrodes disposed on a front surface of the rear substrate and intersecting the pairs of sustain electrodes, a rear dielectric layer covering the address electrodes, barrier ribs disposed on the rear dielectric layer and dividing a discharge space into discharge cells, and fluorescent layers disposed in the discharge cells. The address electrodes are connected to connection cables (not shown) disposed at upper and lower sides of the PDP.

In the PDP, in addition to the pairs of the sustain electrodes which generate a discharge, the front dielectric layer and the protective layer are formed on the rear surface of the front substrate through which visible light generated by the fluorescent layers in the discharge cells is transmitted. The transmittance of visible light is significantly reduced and the brightness of the PDP is therefore also reduced.

Furthermore, since the pairs of sustain electrodes are formed on the rear surface of the front substrate in the PDP, the majority of the sustain electrodes (i.e., the transparent electrodes, excluding the bus electrodes) must be formed of ITO, which is highly resistive, in order to allow the generated visible light to be transmitted through the front substrate. Thus, a driving voltage of the PDP increases and since the high resistance of the ITO electrodes causes a voltage drop, images cannot be uniformly displayed when the PDP is large.

In the PDP, the pairs of sustain electrodes are formed on the rear surface of the front substrate, and the discharge occurs behind the protective layer and diffuses within the discharge cells. In other words, the discharge occurs only on a portion of the discharge cells and a space in the discharge cells cannot be efficiently utilized. As a result, a driving voltage for discharging must be increased, and thus, the cost of a driving circuit, which is the most expensive piece of equipment in a PDP, increases. Furthermore, due to the concentration of the discharge in a limited space in the discharge cell, the luminous efficiency of the PDP is reduced. When the PDP is used for a long time, a charged discharge gas induces ion sputtering of the fluorescent material in the fluorescent layers due to the electric field, thereby resulting in permanent after-images.

SUMMARY OF THE INVENTION

The present invention provides a Plasma Display Panel (PDP) having a high discharge cell aperture ratio, a high light transmittance, and a high luminous efficiency and in which a stable and efficient discharge occurs uniformly at a low driving voltage on inner sidewalls of the discharge cell and is concentrated in the center of the discharge cell.

According to an aspect of the present invention, a Plasma Display Panel (PDP) is provided comprising: a front substrate and a rear substrate facing each other and separated from each other; barrier ribs of a dielectric material arranged between the front substrate and the rear substrate to define discharge cells together with the front substrate and the rear substrate; discharge electrodes arranged within the barrier ribs, the discharge electrodes being separated from each other and surrounding the discharge cells and having at least one corner portion for surrounding the discharge cells; fluorescent layers arranged in the discharge cells; a discharge gas contained within the discharge cells; and an attenuator adapted to reduce a strength of an electric field generated between at least one pair of corner portions of the discharge electrodes, the corner portions facing each other, to be less than a strength of an electric field generated between portions of the discharge electrodes facing each other, other than the corner portions, in the discharge cells.

The attenuator preferably comprises the at least one pair of the facing corner portions of the discharge electrodes, a distance between the facing corner portions being longer than a distance between the portions of the facing discharge electrodes other than the corner portions in the discharge cells.

The attenuator alternatively preferably comprises the at least one pair of the facing corner portions of the discharge electrodes, the facing corner portions being bent in a direction to be farther from each other.

The attenuator alternatively preferably comprises the at least one pair of the facing corner portions of the discharge electrodes, a total thickness of the facing corner portions being less than a total thickness of the portions of the facing discharge electrodes other than the corner portions.

The attenuator alternatively preferably comprises the at least one pair of the facing corner portions of the discharge electrodes having a concave portion on at least one of their facing surfaces.

The attenuator alternatively preferably comprises the at least one pair of the facing corner portions of the discharge electrodes, having a concave portion on at least one of the surfaces other than the facing surfaces.

The attenuator alternatively preferably comprises the at least one pair of the facing corner portions of the discharge electrodes, at least one corner portion having a higher resistivity than the portions of the discharge electrodes other than the corner portion.

The discharge electrodes preferably extend in parallel to each other and address electrodes extend to cross the discharge electrodes.

The PDP preferably further comprises a dielectric layer arranged on the rear substrate to cover address electrodes.

The discharge electrodes alternatively preferably cross each other at a discharge cell.

The discharge electrodes preferably each have a ladder shape and at least a portion of each sidewall of the barrier ribs is coated with a protective layer.

Each of the barrier ribs preferably has a central barrier rib portion and side barrier rib portions and each of the discharge electrodes is coated with a protective layer.

The barrier ribs preferably comprise: front barrier ribs formed on a rear surface of the front substrate and rear barrier ribs formed on a front surface of the rear substrate, the discharge electrodes being arranged in the front barrier ribs; and fluorescent layers arranged in a space defined by the rear barrier ribs and the rear substrate.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
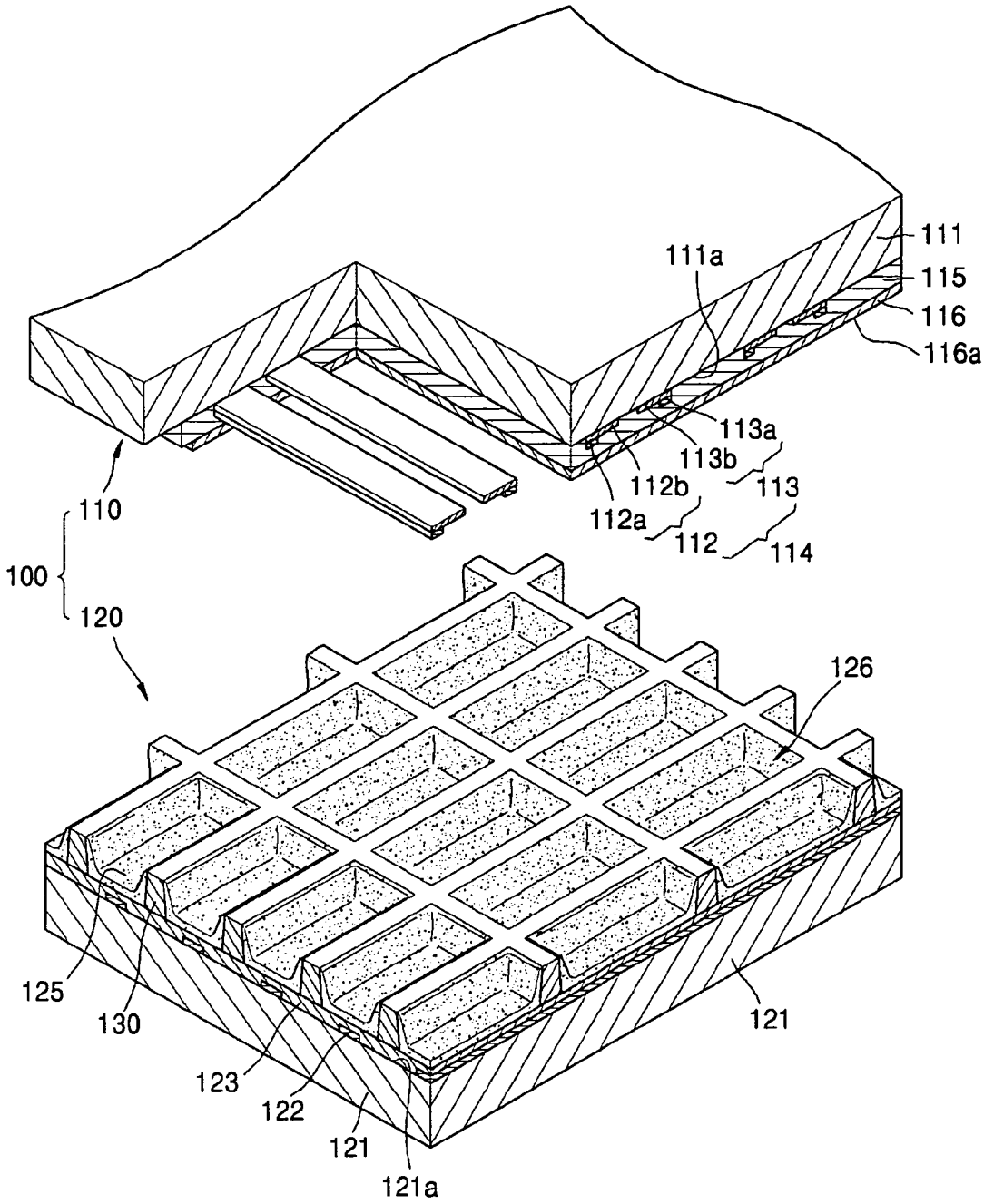
FIG. 1 is a partially cutaway exploded perspective view of an AC, triode-type, surface discharge PDP.

FIG. 1 is a partially cutaway exploded perspective view of a portion of an AC, triode-type, surface discharge PDP 100. Referring to FIG. 1, the PDP comprises a front panel 110 and a rear panel 120. The front panel 110 comprises a front substrate 111, pairs of sustain electrodes 114 composed of Y electrodes 112 and X electrodes 113 on a rear surface 111*a* of the front substrate 111, a front dielectric layer 115 covering the sustain electrodes 114, and a protective layer 116 covering the front dielectric layer 115. Each of the Y electrodes 112 is 14 composed of a transparent electrode 112*b* and a bus electrode 112*a*, and each of the X electrodes 113 is composed of a transparent electrode 113*b* and a bus electrode 113*a*. The transparent electrodes 112*b* and 113*b* are made of Indium Tin Oxide (ITO) or the like. The bus electrodes 112*a* and 113*a* are connected to connection cables (not shown) disposed at right and left sides of the PDP 100.

The rear panel 120 comprises a rear substrate 121, address electrodes 122 disposed on a front surface 121*a* of the rear substrate 121 and intersecting the pairs of sustain electrodes 114, a rear dielectric layer 123 covering the address electrodes 122, barrier ribs 130 disposed on the rear dielectric layer 123 and dividing a discharge space into discharge cells 126, and fluorescent layers 125 disposed in the discharge cells 126. The address electrodes 122 are connected to connection cables (not shown) disposed at upper and lower sides of the PDP 100.

In the PDP 100, in addition to the pairs of the sustain electrodes 114 which generate a discharge, the front dielectric layer 115 and the protective layer 116 are formed on the rear surface 111*a* of the front substrate 111 through which visible light generated by the fluorescent layers 125 in the discharge cells 126 is transmitted. The transmittance of visible light is significantly reduced and the brightness of the PDP 100 is therefore also reduced.

Furthermore, since the pairs of sustain electrodes 114 are formed on the rear surface 111*a* of the front substrate 111 in the PDP 100, the majority of the sustain electrodes 114 (i.e., the transparent electrodes 112*b* and 113*b*, excluding the bus electrodes 112*a* and 113*a*) must be formed of ITO, which is highly resistive, in order to allow the generated visible light to be transmitted through the front substrate 111. Thus, a driving voltage of the PDP 100 increases and since the high resistance of the ITO electrodes causes a voltage drop, images cannot be uniformly displayed when the PDP 100 is large.

In the PDP 100, the pairs of sustain electrodes 114 are formed on the rear surface 111*a* of the front substrate 111, and the discharge occurs behind the protective layer 116 and diffuses within the discharge cells 126. In other words, the discharge occurs only on a portion of the discharge cells 126 and a space in the discharge cells 126 cannot be efficiently utilized. As a result, a driving voltage for discharging must be increased, and thus, the cost of a driving circuit, which is the most expensive piece of equipment in a PDP, increases. Furthermore, due to the concentration of the discharge in a limited space in the discharge cell, the luminous efficiency of the PDP 100 is reduced. When the PDP 100 is used for a long time, a charged discharge gas induces ion sputtering of the fluorescent material in the fluorescent layers 125 due to the electric field, thereby resulting in permanent after-images.

Figure 2B:
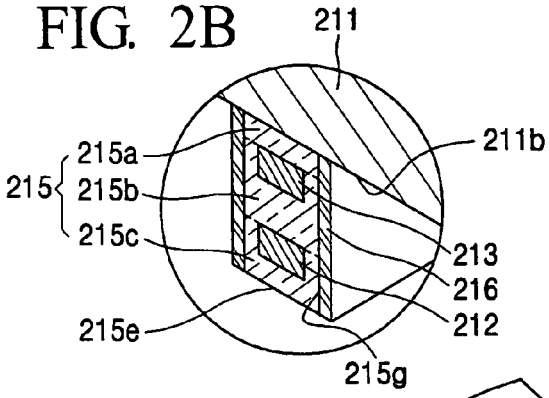
FIG. 2B is an expanded portion of FIG. 2A contained within the dotted circle thereof.
Figure 2A:
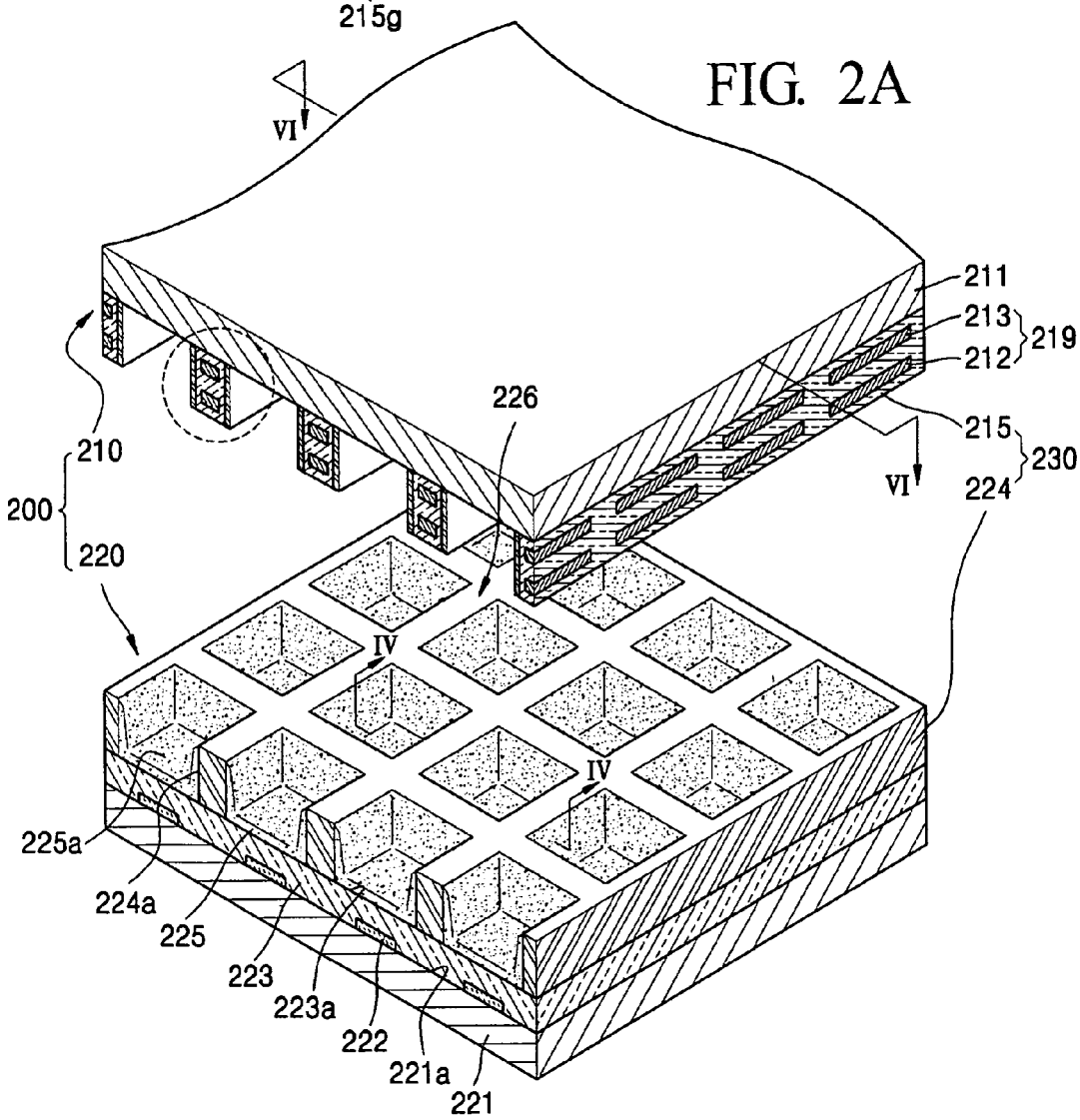
FIG. 2A is a partially cutaway exploded perspective view of a PDP according to an embodiment of the present invention.

FIG. 2A is a partially cutaway exploded perspective view of a plasma display panel (PDP) 200 according to an embodiment of the present invention and FIG. 2B is an expanded portion of FIG. 2A contained within the dotted circle thereof. Referring to FIGS. 2A and 2B, the PDP 200 comprises a front panel 210 and a rear panel 220. Barrier ribs 230 are located between the front panel 210 and the rear panel 220 to define discharge cells 226 in which a discharge occurs and light is generated, in order to realize images. The barrier ribs 230 can comprise front barrier ribs 215 and rear barrier ribs 224 with regard to the manufacturing process.

The front panel 210 comprises a transparent front substrate 211, and the rear panel 220 comprises a rear substrate 221 parallel to and facing the front substrate 211.

Front barrier ribs 215 are located on a rear surface 211*b* of the front substrate 211 to define discharge cells 226 together with the front substrate 211, the rear substrate 221, and rear barrier ribs 224. The front panel 210 comprises discharge electrodes 219 located in the front barrier ribs 215 to surround the discharge cells 226. The discharge electrodes 219 are separated from the front substrate 211 and include front discharge electrodes 213 and rear discharge electrodes 212. The rear discharge electrodes 212 extend parallel to the front discharge electrodes 213 in a predetermined direction.

The front panel 210 can comprise protective layers 216 covering outer sidewalls 215*g* of the front barrier ribs 215, if necessary. The protective layers 216 can be formed on outer sidewalls 224*a* of the rear barrier ribs 224 or front surfaces 225*a* of fluorescent layers 225, in addition to the outer sidewalls 215*g* of the front barrier ribs 215.

The rear panel 220 comprises the rear substrate 221, address electrodes 222 located on a front surface 221*a* of the rear substrate 221 and extending to cross the discharge electrodes 219, a dielectric layer 223 covering the address electrodes 222, the rear barrier ribs 224 located on the dielectric layer 223, and the fluorescent layers 225 located in spaces defined by the rear barrier ribs 224.

The front panel 210 and the rear panel 220 are combined with each other using a combination member (not shown) and sealed. The combination member can be a frit. The discharge cells 226 are filled with a discharge gas, such as Neon (Ne), Helium (He), and Argon (Ar), each containing about 10% of Xenon (Xe) gas, or a mixture thereof.

The front substrate 211 and the rear substrate 221 are generally made of glass. The front substrate 211 is made of a material having a high light transmittance. The PDP 200 does not include elements of the PDP 100 of FIG. 1 such as the sustain electrodes 114 on the rear surface 111*b* of the front substrate 111, the front dielectric layer 115 covering the sustain electrodes 114, and the protective layer 116 covering the front dielectric layer 115, in a portion of the rear surface 211*b* of the front substrate 211, which defines the discharge cells 226. Thus, unlike the PDP 100, the visible light generated by the fluorescent layers 225 is transmitted only through the transparent front substrate 211, which has a high light transmittance, thereby greatly increasing forward transmittance. As a result, the brightness of the PDP 200 is greatly increased.

In order to increase the brightness of the PDP 200, a reflective layer (not shown) can be located on the front surface 221*a* of the rear substrate 221 or the front surface 223*a* of the dielectric layer 223, or a light reflective material can be contained in the dielectric layer 223 such that the visible light generated by the fluorescent layers 225 is efficiently reflected forward.

In the AC, triode-type, surface discharge PDP 100, in order to increase the light transmittance, the discharge electrodes are made of ITO, which has a relatively high resistance. However, in the PDP 200 of FIGS. 2A and 2B, the front discharge electrodes 213 and the rear discharge electrodes 212 can be made of materials which have high electrical conductivity, such as Ag, Cu, Cr, etc., regardless of light transmittance.

The barrier ribs 230 are located between the front substrate 211 and the rear substrate 221 to define the discharge cells 226 together with the front substrate 211 and the rear substrate 221. The discharge cells 226 are defined into a matrix shape by the barrier ribs 230 in FIG. 2, but are not limited thereto. The shape of the discharge cells 226 will be described in more detail later.

The discharge electrodes 219 are located in the front barrier ribs 215 to surround the discharge cells 226. The discharge electrodes 219 can include the front discharge electrodes 213 and the rear discharge electrodes 212.

Positioning of the front discharge electrodes 213 and the rear discharge electrodes 212 in the front barrier ribs 215 will be explained with reference to FIG. 2B. Referring to FIG. 2B, a first front barrier rib layer 215*a* is formed on the rear surface 211*b* of the front substrate 211. Then, a front discharge electrode 213 is formed on the first front barrier rib layer 215*a*, and a second front barrier rib layer 215*b* is formed to cover the front discharge electrode 213. Next, a rear discharge electrode 212 is formed on the second front barrier rib layer 215*b*, and a third front barrier rib layer 215*c* is formed to cover the rear discharge electrode 212.

The first, second, and third front barrier rib layers 215*a*, 215*b*, and 215*c* can be made of dielectric materials, such as glass containing elements such as Pb, B, Si, Al, and O, and if necessary, a filler such as $ZrO_2$, $TiO_2$, and $Al_2O_3$ and a pigment such as Cr, Cu, Co, Fe, $TiO_2$.

When a voltage pulse is supplied between the front discharge electrode 213 and the rear discharge electrode 212, the above dielectric materials induce charged particles and thus, induce the wall charges, and prevent the front discharge electrode 213 and the rear discharge electrode 212 from colliding with accelerated charged particles.

After the front barrier rib 215 is formed, the protective layer 216 can be formed on the outer sidewall 215*g* of the front barrier rib 215 by deposition, etc. The protective layer 216 can protect the front discharge electrode 213, the rear discharge electrode 212, and the front barrier rib 215, and emit secondary electrons during the discharge, thereby allowing the discharge to be easily generated. During the formation of the protective layer 216, a protective layer can be further formed on the rear surface 211*b* of the front substrate 211 and on the rear surface 215*g* of the front barrier rib 215. The protective layer thus formed does not have an adverse effect on the operation of the PDP 200.

Referring to FIGS. 2A and 2B, rear barrier ribs 224 can be formed on the dielectric layer 223. The rear barrier ribs 224 can be made of dielectric materials, such as glass containing elements such as Pb, B, Si, Al, and O, and if necessary, a filler such as $ZrO_2$, $TiO_2$, and $Al_2O_3$ and a pigment such as Cr, Cu, Co, Fe, $TiO_2$, as in the front barrier ribs 215.

The rear barrier ribs 224 define spaces on which the fluorescent layers 225 are coated and, together with the front barrier ribs 215, resist the force of the vacuum (for example, 0.5 atm) of the discharge gas filled between the front panel 210 and the rear panel 220. The rear barrier ribs 224 also define spaces for the discharge cells 226 and prevent cross-talk between the discharge cells 226. The rear barrier ribs 224 can contain a reflective material to reflect the visible light generated in the discharge cells 226 forward. The fluorescent layers 225, which emit red, green, or blue light, can be located in the spaces defined by the rear barrier ribs 224. The fluorescent layers 225 are divided by the rear barrier ribs 224.

The fluorescent layers 225 are formed by coating a fluorescent paste comprising either red, green, or blue light-emitting fluorescent material, a solvent, and a binder, on the front surface 223*a* of the dielectric layer 223 and the outer sidewalls 224*a* of the rear barrier ribs 224, and drying and baking the resultant structure. The red light-emitting fluorescent material can be Y(V,P)O4:Eu, etc., the green light-emitting fluorescent material can be ZnSiO4:Mn, $YBO_3$:Tb, etc. and the blue light-emitting fluorescent material can be BAM:Eu, etc.

The rear protective layers (now shown), made of, for example, MgO, can be formed on the front surfaces 225*a* of the fluorescent layers 225. When the discharge occurs in the discharge cells 226, the rear protective layers can prevent deterioration of the fluorescent layers 225 due to collisions with the discharge particles and emit secondary electrons, thereby allowing the discharge to be easily generated.

Figure 3:
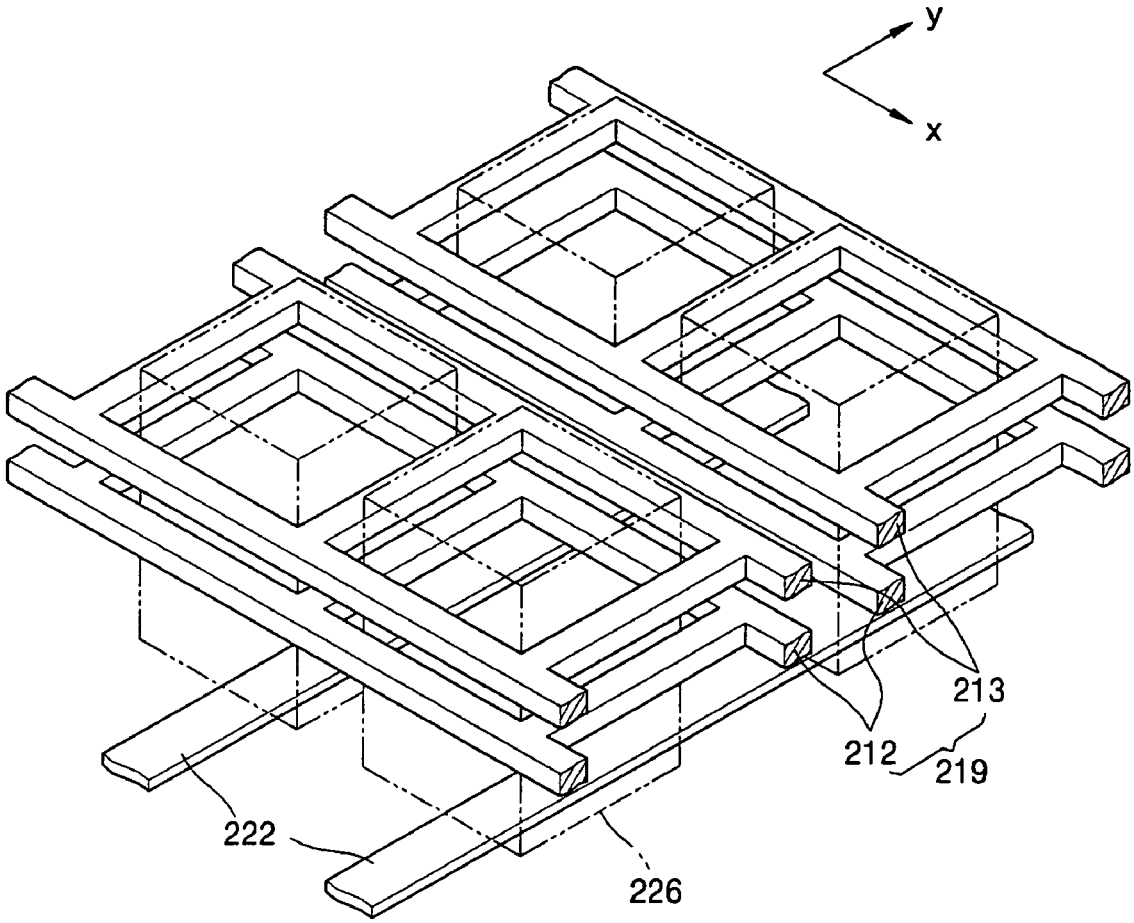
FIG. 3 is an exploded perspective view of discharge electrodes, discharge cells, and address electrodes of the PDP of FIG. 2.

FIG. 3 illustrates discharge electrodes 219, address electrodes 222, and discharge cells 226 of the PDP 200 illustrated in FIG. 2.

Referring to FIG. 3, front discharge electrodes 213 and rear discharge electrodes 212 each have a ladder shape and extend in parallel in the x-axis direction. The address electrodes 222 extend in the y-axis direction crossing the front discharge electrodes 213 and the rear discharge electrodes 212.

Since the rear discharge electrodes 212 are close to the address electrodes 222, an address discharge for selecting one of the discharge cells 226 in which a sustain discharge occurs preferably occurs between the rear discharge electrodes 212 and the address electrodes 222. The rear discharge electrodes 212 can be common electrodes and the front discharge electrodes 213 can be scan electrodes, but are not limited thereto.

Figure 4:
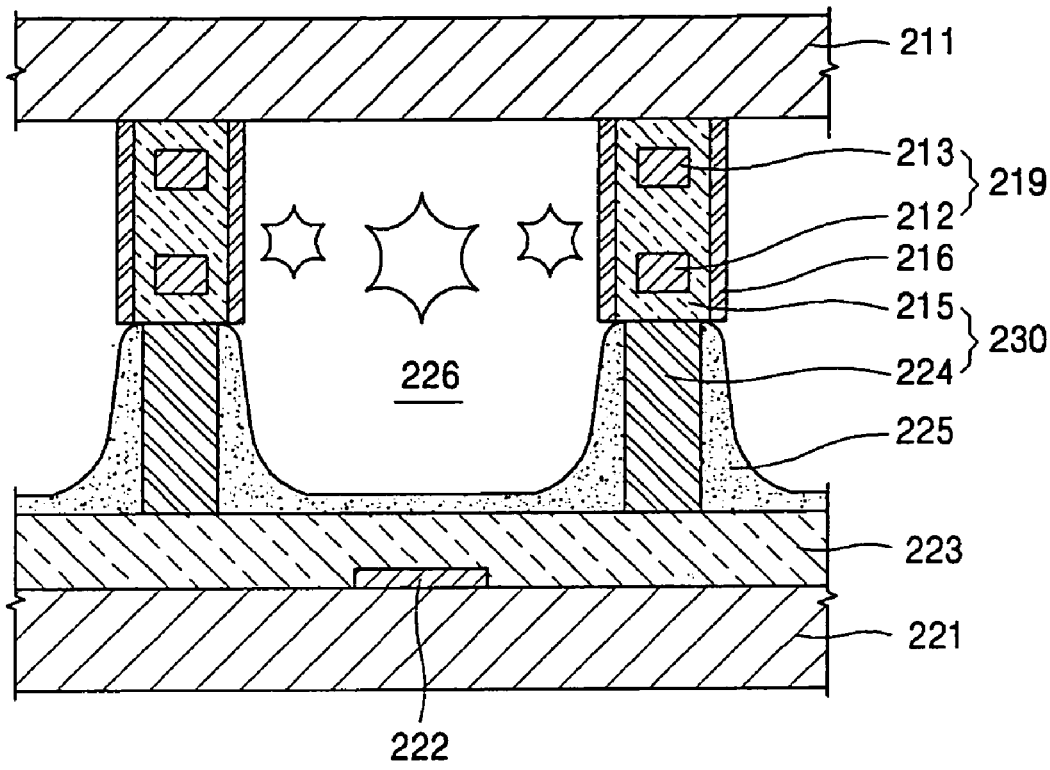
FIG. 4 is a cross-sectional view taken along line IV-IV of the PDP of FIG. 2.

The operation of the PDP 200 of FIG. 2 is explained briefly below, referring to FIG. 4.

When a predetermined address voltage is supplied between the address electrodes 222 and the rear discharge electrodes 212, one of the discharge cells 226 is selected and wall charges accumulate on the sidewalls of the front barrier ribs 215 in which the rear discharge electrodes 212 are located, in the selected discharge cell 226. Such a discharge is called an address discharge.

After the address discharge occurs, a sustain discharge occurs. The sustain discharge will now be explained. When a high pulse voltage is supplied to the front discharge electrodes 213 and a low pulse voltage is supplied to the rear discharge electrodes 212, wall charges move due to the voltage difference between the front discharge electrodes 213 and the rear discharge electrodes 212, and collide with discharge gas atoms, thereby generating a discharge and creating plasma. The discharge occurs more easily when the front discharge electrodes 213 are close to the rear discharge electrodes 212 since a stronger electric field is formed there.

Unlike the AC, triode-type, surface discharge PDP 100, the PDP 200 comprises the discharge electrodes 219 located in the barrier ribs 230 to surround the discharge cells 226 and thus, a probability that a discharge occurs at sidewalls of the discharge cells 226 near the front discharge electrodes 213 and the rear discharge electrodes 212 is increased and the discharge can occur inner sidewalls of the discharge cells 226. Thus, the discharge is generated more easily and over a greater area, compared to the PDP 100.

When the discharge occurs successfully along the inner sidewalls of the discharge cells 226 and the voltage difference between the discharge electrodes 219 is maintained for a predetermined time, the electric field generated on the sidewalls of the discharge cells 226 is concentrated in the central portions of the discharge cells 226. Thus, the discharge region is much larger than in the PDP 100, thereby increasing the amount of UV light generated by the discharge. Furthermore, since the discharge diffuses from the walls of the discharge cells 126 to the centers, ion collision with the fluorescent layers 225 is inhibited and thus, ion sputtering is prevented.

When the voltage difference between the discharge electrodes 219 becomes lower than the discharge voltage after the discharge, the discharge is no longer generated, and space charges and wall charges accumulate in the discharge cells 226.

When a low pulse voltage is supplied to the front discharge electrodes 213 and a high pulse voltage is supplied to the rear discharge electrodes 212, the difference between these supplied pulse voltages and the wall charges previously formed have a synergistic effect to allow the voltage difference to reach the firing voltage and thus, a discharge is again generated.

When the polarity of the pulse voltage supplied between the discharge electrodes 219 is repeatedly changed, the discharge is maintained. The UV light generated by the discharge strikes the fluorescent layers 225, thereby exciting fluorescent molecules in the fluorescent layers 225. When the energy level of the excited fluorescent molecules drops, visible light of a predetermined wavelength is generated, thereby displaying images.

As described above, to ensure that the space in the discharge cells 226 is efficiently utilized, the discharge is concentrated in the centers of the discharge cells 226 rather than on the sidewalls of the discharge cells 226 to increase the discharge efficiency.

Although constant voltages are supplied to the discharge electrodes 219, the uniform discharge cannot be sufficiently attained, since the discharge does not occur due to the voltages supplied to the discharge electrodes 219, but rather due to the voltage difference between the discharge electrodes 219. When an electric field is generated in the discharge cells 226 due to the voltage difference, wall charges have a kinetic energy and arbitrarily collide with a discharge gas to generate plasma particles and thus, the discharge occurs. That is, the electric field generated in the discharge cells 226 can be a more important factor for the uniform discharge than the voltages supplied between the discharge electrodes 219. Such an electric field can greatly depend on a shape or a material of the discharge electrodes 219.

Thus, to confirm that the uniform discharge occurs along the inner sidewalls of the discharge cells 226 due to the voltages supplied between the discharge electrodes 219, there is a need to confirm a distribution of the electric field generated in the discharge cells 226 due to the voltages supplied between the discharge electrodes 219.

Figure 5A:
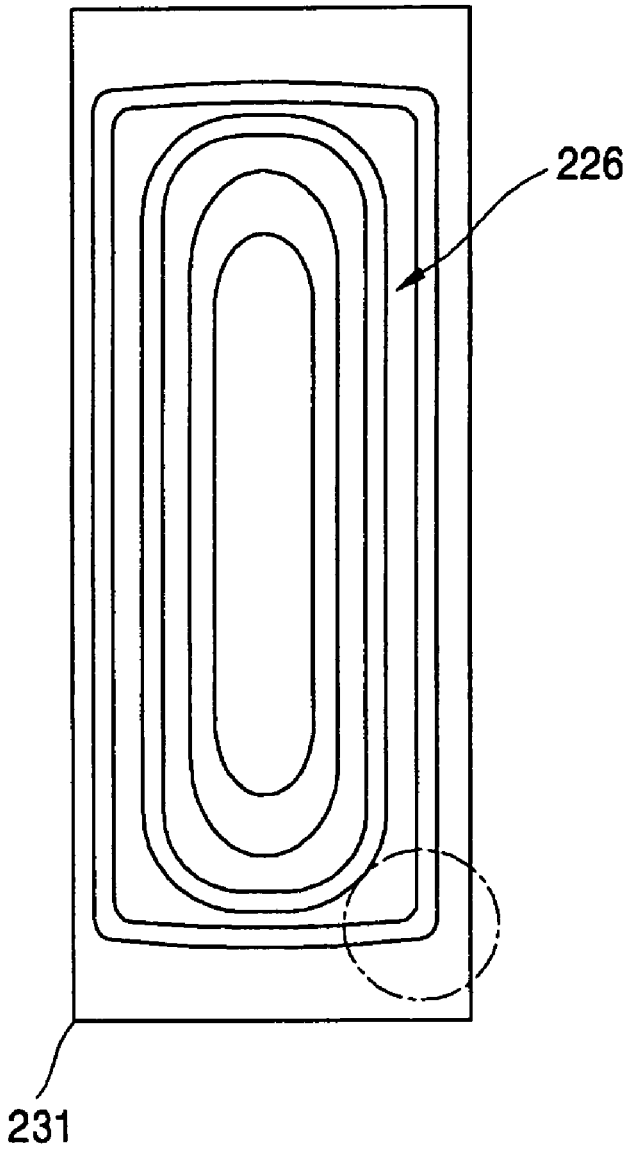
FIG. 5A is a plan view of a distribution of an electric field in a discharge cell of a PDP according to an embodiment of the present invention.
Figure 5B:
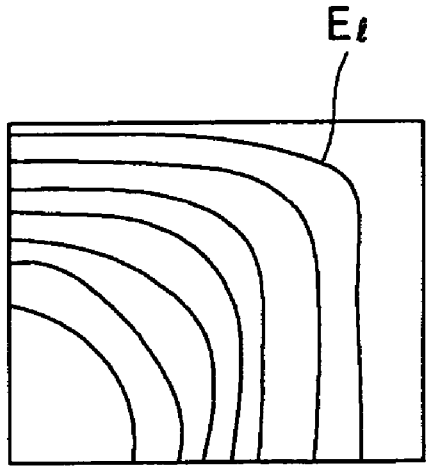
FIG. 5B is an expanded portion of FIG. 5A contained within the dotted circle thereof.

The distribution of the electric field in a discharge cell 226 is described below with reference to FIGS. 5A and 5B and 6. FIGS. 5A and 5B illustrate equipotential surfaces E1 formed in a discharge cell 226 when a voltage which can induce a sustain discharge is supplied between discharge electrodes 219 in the discharge cell 226.

Referring to FIGS. 5A and 5B, the equipotential surfaces E1 are formed in the discharge cell 226 to surround the discharge cell 226. Since a direction of an electric field is perpendicular to an equipotential surface and the equipotential surfaces E1 surround the discharge cell 226, the electric field is concentrated in the center of the discharge cell 226.

Although the electric field is concentrated in the center of the discharge cell 226, if a discharge occurs only on a limited surface in the discharge cell 226, the discharge cannot efficiently extend to the center thereof, i.e., the discharge cannot efficiently occur. From this consideration, it is confirmed that the electric field is preferably generated uniformly along the inner sidewalls of the discharge cell 226 to ensure that the discharge uniformly occurs in the entire discharge cell 226. The equipotential surfaces E1 in corner portions 231 of the discharge cell 226 are rounded against the corner portions 231 and since the electric field is generated perpendicular to the equipotential surfaces E1, the electric field is highly concentrated especially in the corner portions 231.

Figure 6:
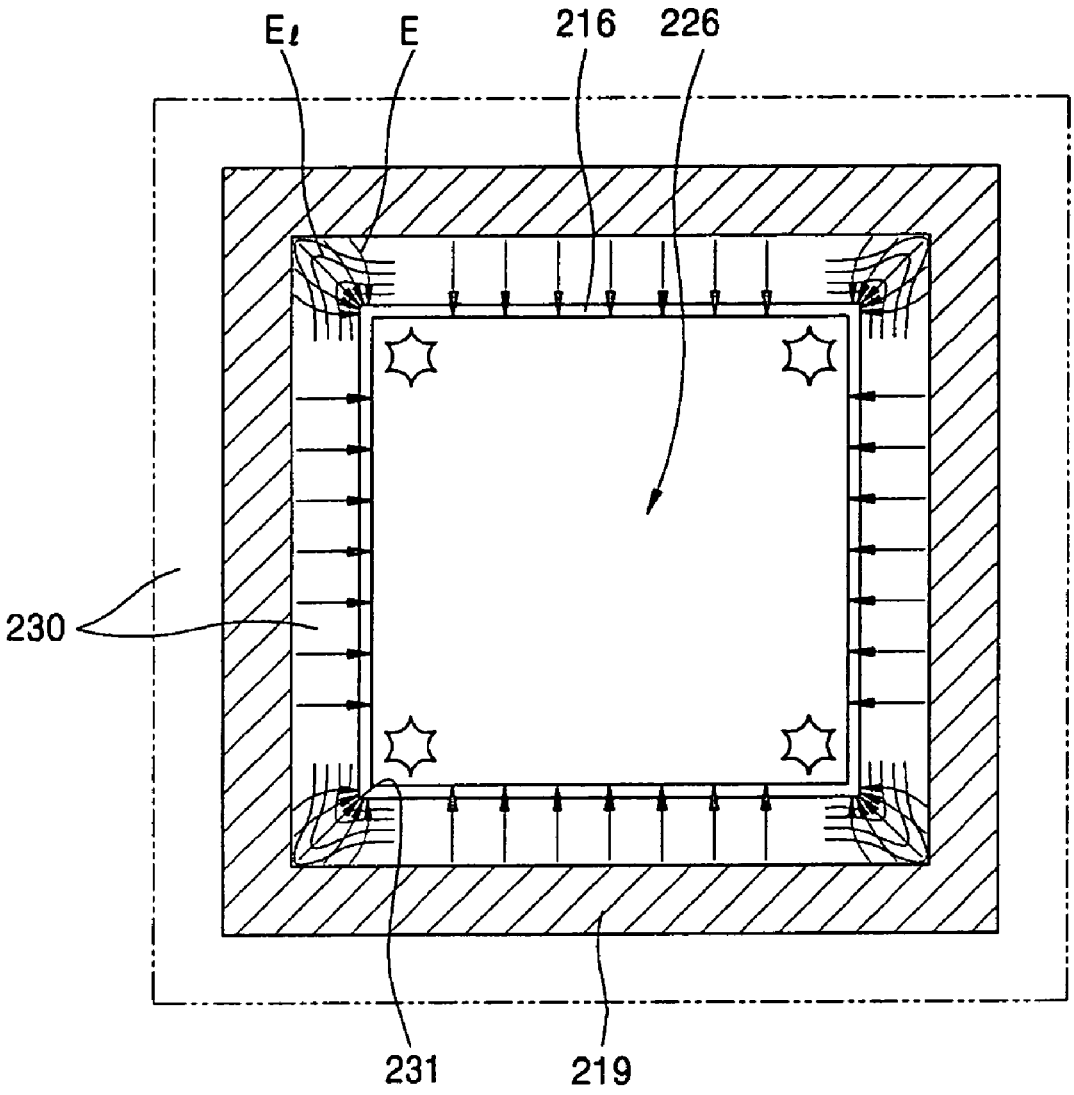
FIG. 6 is a cross-sectional view taken along line VI-VI of the PDP of FIG. 2 showing a distribution of an electric field in a discharge cell.

Referring to FIG. 6 for a more detailed explanation, equipotential surfaces E1 are formed near the corner portions 231 of a discharge cell 226 and an electric field E is concentrated in the corner portions 231. An electric field is uniformly generated on sidewalls of the discharge cell 226 other than the corner portions 231, and thus, less concentrated in the sidewalls than in the corner portions 231. Based on this, it can be estimated that a strength of the electric field in the corner portions 231 of the discharge cell 226 is greater than a strength of the electric field in the portions of the discharge cell 226 other than the corner portions 231.

The characteristic distribution of the electric field implies that a high strength electric field E is generated only in the corner portions 231 of the discharge cell 226 and wall charges generated in the corner portions 231 have still higher kinetic energy than wall charges generated in the inner sidewalls of the discharge cell 226 other than the corner portions 231. Thus, a probability that the discharge occurs in the corner portions 231 of the discharge cell 226 is increased. This does not comply with the original intention of the invention to design the discharge cells such that the discharge can uniformly occur along the inner sidewalls of the discharge cell 226.

To overcome this problem, a attenuator such that a strength of an electric field generated between corner portions of discharge electrodes, the corner portions facing each other, is less than a strength of an electric field generated between portions of the discharge electrodes facing each other, other than the corner portions, should be supplied to discharge cells. The attenuator will now be described in detail.

Figure 7:
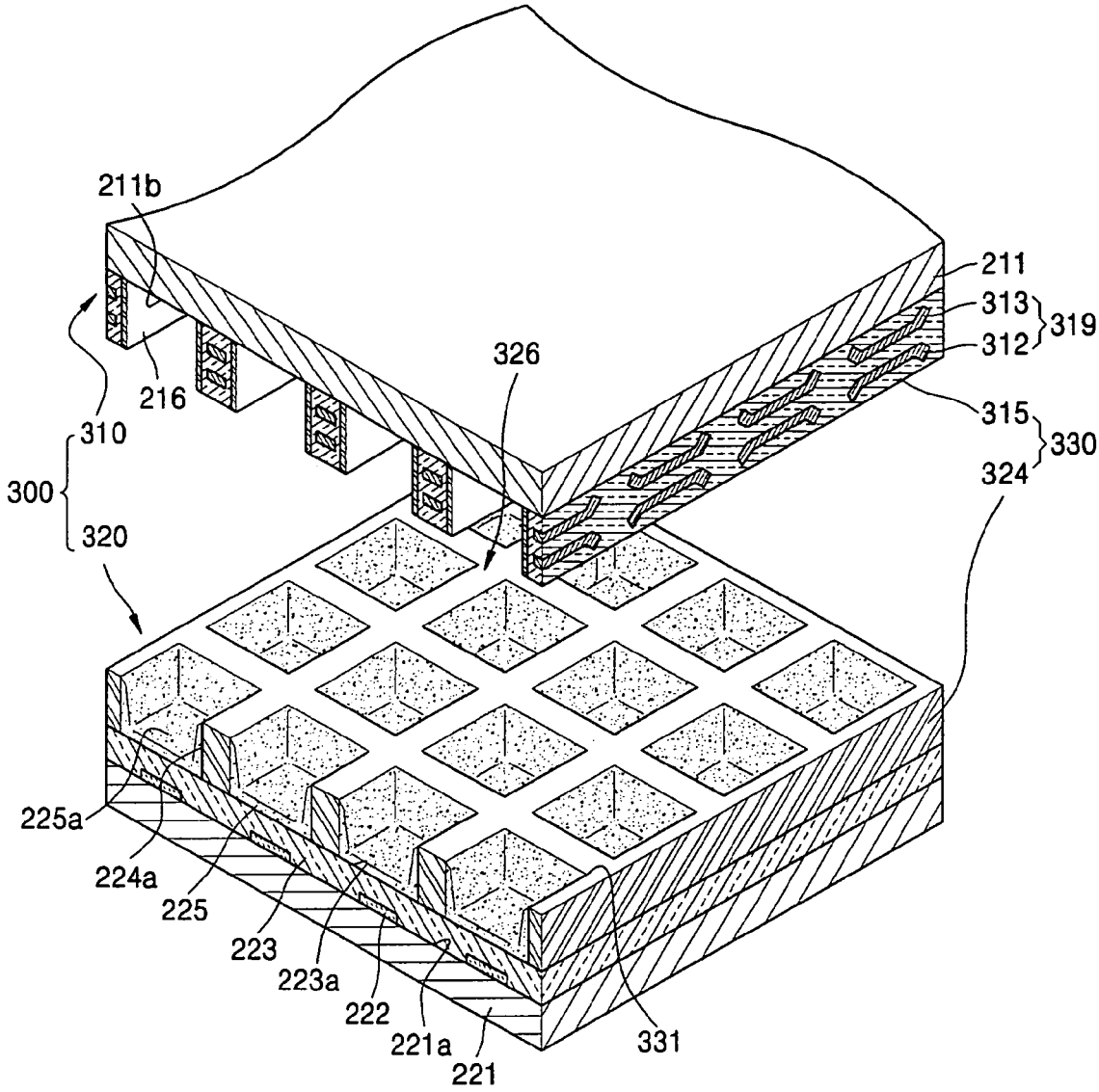
FIG. 7 is a partially cutaway exploded perspective view of a PDP according to an embodiment of the present invention.
Figure 8:
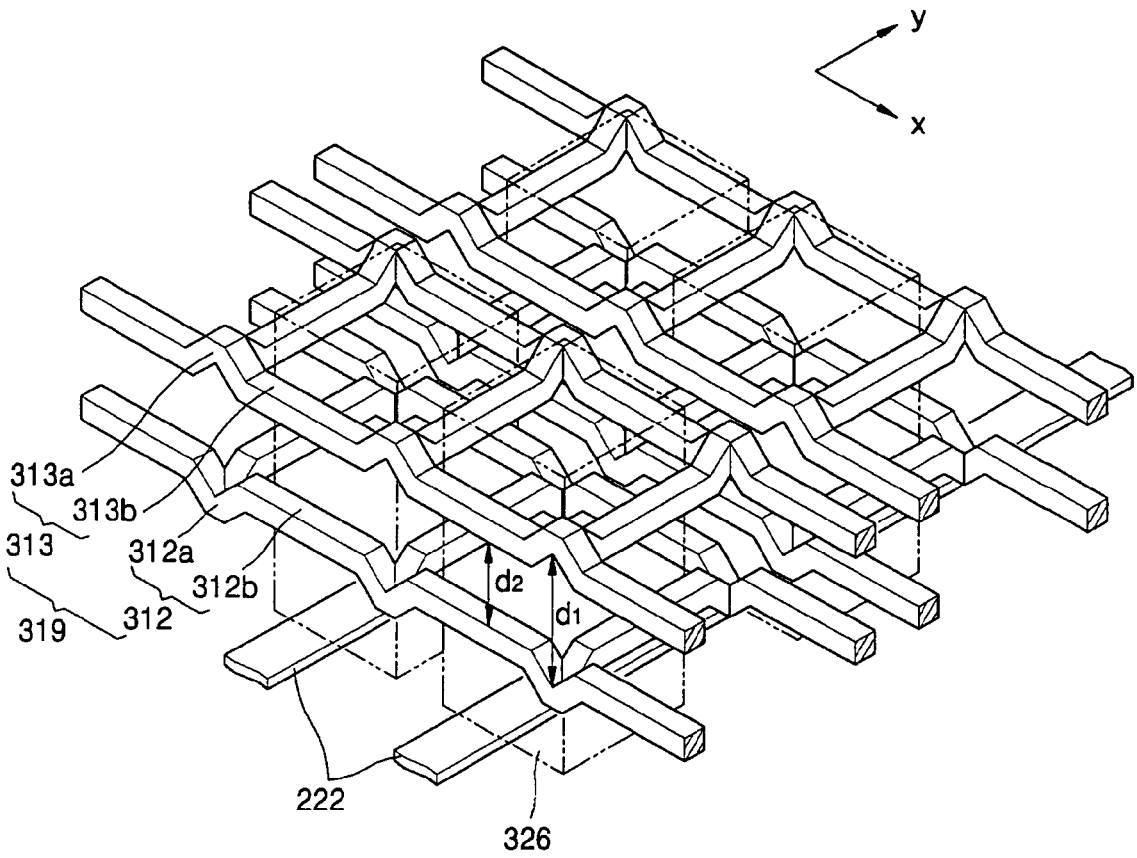
FIG. 8 is an exploded perspective view of discharge electrodes, address electrodes, and discharge cells of the PDP of FIG. 7.

FIG. 7 is a partially cutaway exploded perspective view of a PDP 300 according to an embodiment of the present invention. FIG. 8 is an exploded perspective view of discharge electrodes 319, address electrodes 222, and discharge cells 326 of the PDP 300 illustrated in FIG. 7. Referring to FIGS. 7 and 8, the PDP 300 will be explained based on the differences from the PDP 200 of FIG. 2. In the PDP 300, a shape of corner portions of the discharge electrodes 319 is adopted as a attenuator.

Specifically, the electric field in the discharge cells 326 is generated due to a voltage difference between the discharge electrodes 319, i.e., between front discharge electrodes 313 and rear discharge electrodes 312. Thus, to ensure that the strength of the electric field in the corner portions 331 of the discharge cells 326 is identical to the strength of the electric field on inner sidewalls of the discharge cells 326 other than the corner portions 331, a attenuator for reducing a strength of an electric field generated between pairs of corner portions 313*a* and 312*a* of the discharge electrodes 319 is needed.

With respect to an electric field, a strength of an electric field generated due to a voltage supplied between two electrodes is proportional to a voltage difference between the two electrodes divided by a distance between the two electrodes. Thus, when the distance between the two electrodes is increased, the electric field strength between the two electrodes is decreased.

Accordingly, when a distance between the corner portions 313*a* and 312*a* of the discharge electrodes 319, which generates an electric field in the corner portions 331 of the discharge cells 326, is increased to be greater than a distance between the portions 313*b* and 312*b* of the discharge electrodes 319 other than the corner portions 313*a* and 312*a*, a strength of an electric field generated between the pairs of the corner portions 313*a* and 312*a* of the discharge electrodes 319 is less than a strength of an electric field generated between the portions 313*b* and 312*b* of the discharge electrodes 319 other than the corner portions 313*a* and 312*a*. As a result, the strength of the electric field in the corner portions 331 of the discharge cells 326 becomes greater than the strength of the electric field on the inner sidewalls of the discharge cells 326 other than the corner portions 331 due to the concentration of the electric field in the corner portions 331 of the discharge cells.

Referring to FIG. 8, the discharge electrodes 319 of the PDP 300 of FIG. 7 are described below in more detail.

In the PDP 300, to ensure that a distance $d_1$ between corner portions 313*a* and 312*a* of the discharge electrodes 319 is greater than a distance $d_2$ between portions 313*b* and 312*b* of the discharge electrodes 319 other than the corner portions 313*a* and 312*a*, the pairs of the corner portions 313*a* and 312*a* are bent in such a direction that they are farther from each other. Thus, the electric field strength between the pairs of the corner portions 313*a* and 312*a* of the discharge electrodes 319 is less than the electric field strength between the portions 313*b* and 312*b* of the discharge electrodes 319. As a result, the electric field is uniformly generated in the discharge cells 326 and the wall charges on the corner portions 331 of the discharge cells 326 have substantially the same kinetic energy as the wall charges on the inner sidewalls of the discharge cell 326 other than the corner portions 331, and thus, the discharge uniformly occurs along the inner sidewalls of the discharge cells 326.

Figure 9:
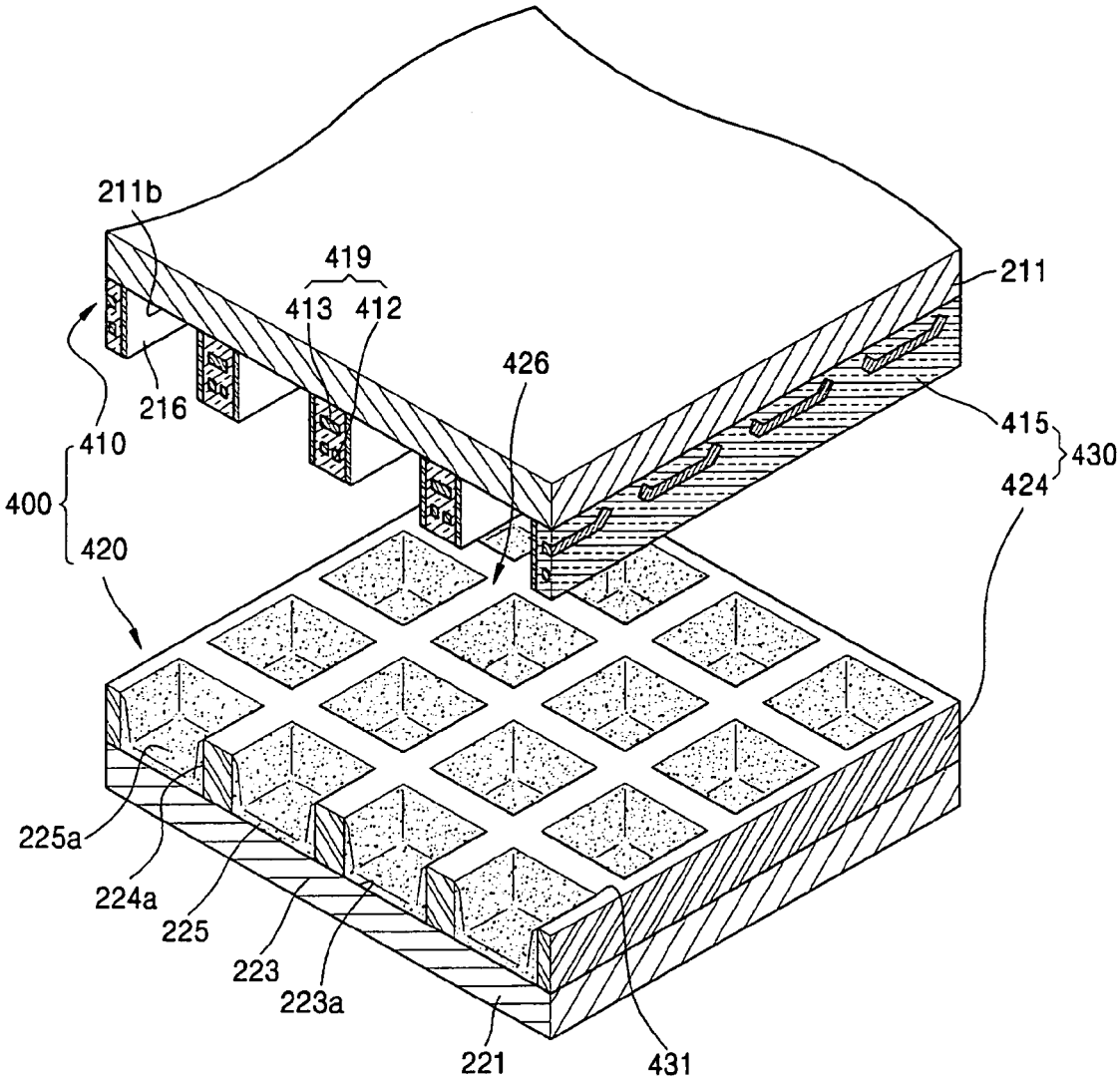
FIG. 9 is a partially cutaway exploded perspective view of a first modified example of the PDP of FIG. 7.
Figure 10:
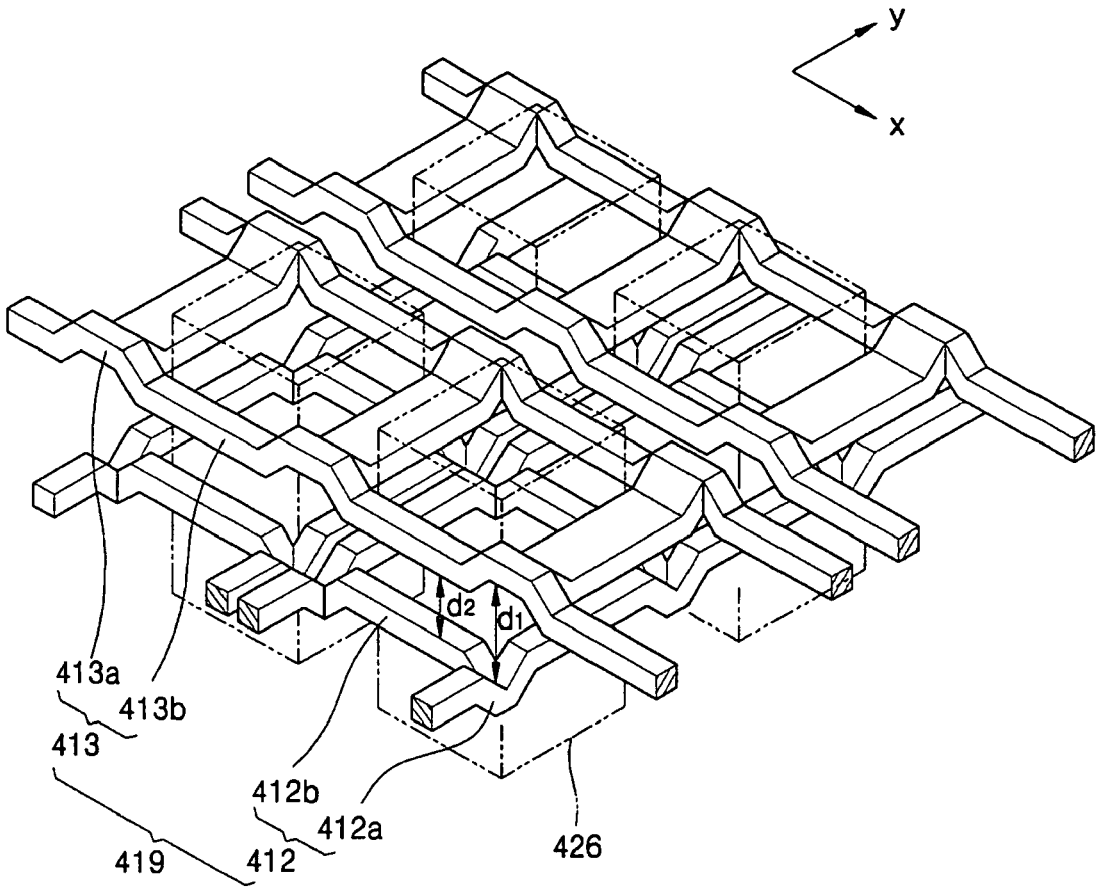
FIG. 10 is an exploded perspective view of discharge electrodes and discharge cells of the PDP of FIG. 9.

FIG. 9 is a partially cutaway exploded perspective view of a first modified example 400 of the PDP 300 of FIG. 7. FIG. 10 is an exploded perspective view of discharge electrodes 419 and discharge cells 426 of the PDP 400 of FIG. 9. Referring to FIGS. 9 and 10, the PDP 400 is explained below based on the differences from the PDP 300 of FIG. 7.

Referring to FIG. 9, the PDP 400 does not comprise the address electrodes 222 which are present in the PDP 300 of FIG. 7. In the PDP 400, the discharge electrodes 419 are disposed to cross each other at the discharge cells 426 and perform the functions of the address electrodes 222. Since the address electrodes 222 are not formed, a dielectric layer 223 covering the address electrodes 222 is not an essential component in the PDP 400.

Referring to FIG. 10, the discharge electrodes 419 comprise front discharge electrodes 413 and rear discharge electrodes 412. Each of the front discharge electrodes 413 has a ladder shape and extends in the x-axis direction, and each of the rear discharge electrodes 412 has a ladder shape and extends in the y-axis direction, crossing the front discharge electrodes 413 at the discharge cells 426.

To prevent a non-uniform discharge due to the concentration of the electric field in corner portions 431 in the PDP 400, pairs of corner portions 413*a* and 412*a* of the discharge electrodes 419 are bent in such a direction that they are farther from each other, such that a distance $d_1$ between the corner portions 413*a* and 412*a* of the discharge electrodes 419 is greater than a distance $d_2$ between portions 413*b* and 412*b* of the discharge electrodes 419 other than the corner portions 413*a* and 412*a*.

The operation of the PDP 400, which does not comprise address electrodes 222, is explained below based on the differences from the PDP 300 of FIG. 7.

In the PDP 400, an address discharge for selecting the discharge cells 426 in which a sustain discharge will occur is determined as follows. First, a predetermined voltage is supplied between the discharge electrodes 419 disposed to cross each other in the discharge cells 426 to be selected and due to the supplied voltage, an electric field is induced and the sustain discharge occurs. As described above, due to the sustain discharge, wall charges are generated on the sidewalls of the discharge cells 426.

Thereafter, as described above, the sustain discharge occurs with the aid of the wall charges by applying a voltage between the discharge electrodes 419 sequentially. Such a procedure is selectively and repeatedly performed for the discharge cells 426 of the PDP 400, and thus, an image is realized.

Figure 11A:
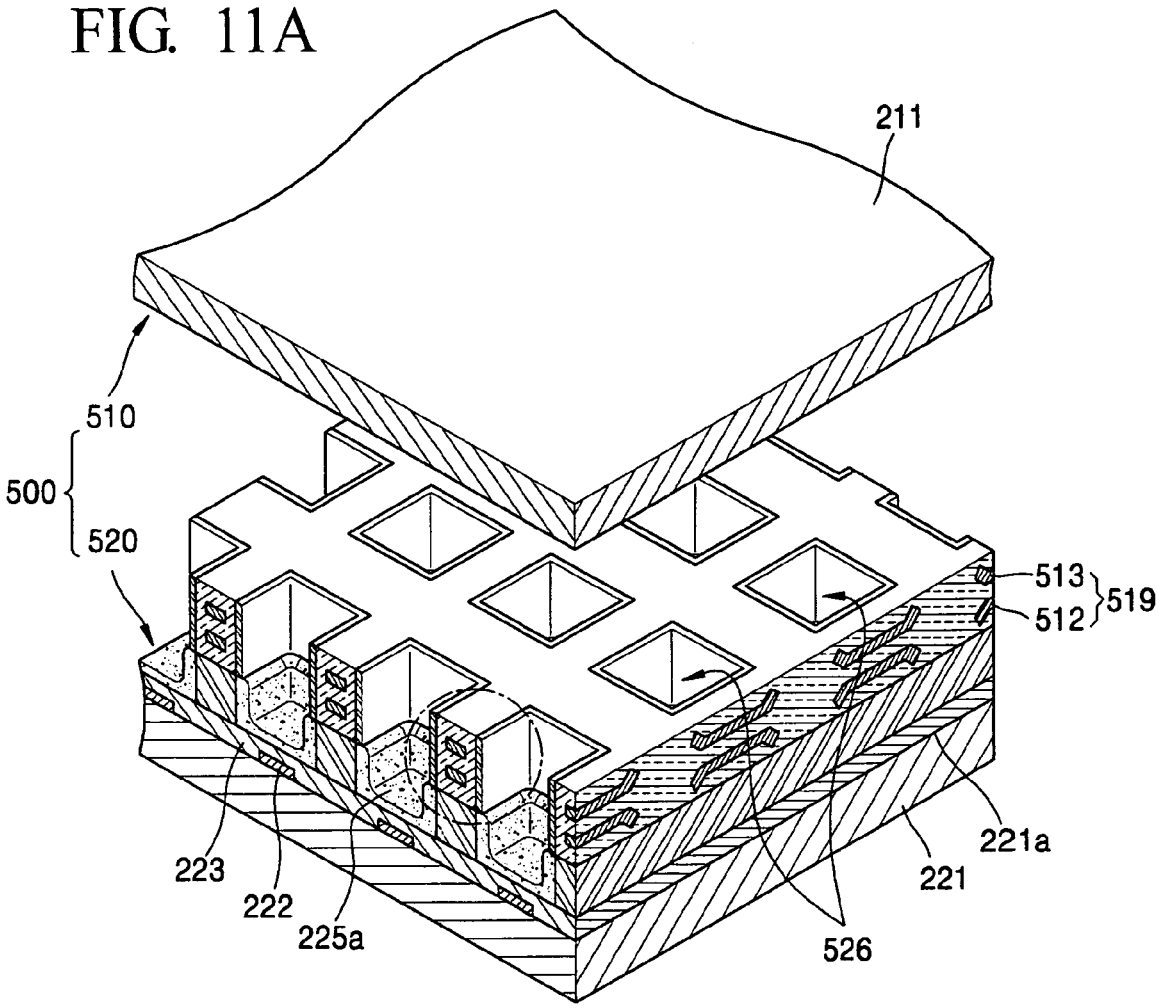
FIG. 11A is a partially cutaway exploded perspective view of a second modified example of the PDP of FIG. 7.
Figure 11B:
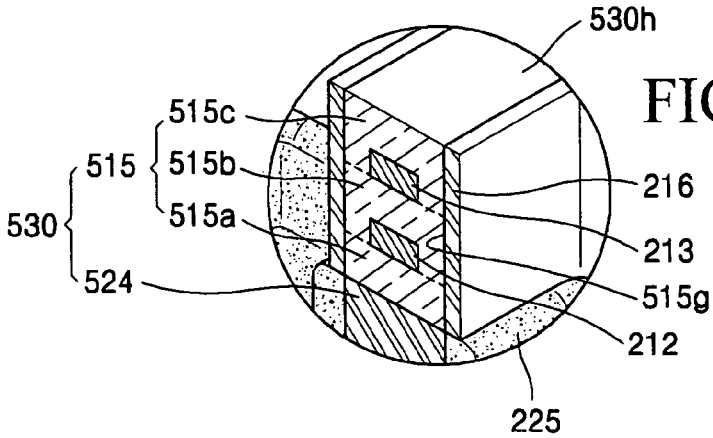
FIG. 11B is an expanded portion of FIG. 11A contained within the dotted circle thereof.

FIGS. 11A and 11B is a partially cutaway exploded perspective view and magnified view of a second modified example 500 of the PDP 300 of FIG. 7. Referring to FIGS. 11A and 11B, the PDP 500 is explained below based on the differences from the PDP 300 of FIG. 7. The PDP 500 differs from the PDP 300 of FIG. 7 in that integrated barrier ribs 530 in the PDP 500 replace the front barrier ribs 215 and the rear barrier ribs 224 in the PDP 300.

The integration of the front barrier ribs 215 and the rear barrier ribs 224 into the integrated barrier ribs 530 means that front barrier ribs 215 and the rear barrier ribs 224 are joined and cannot be separated without breaking, but the barrier ribs 530 are not produced in one process.

The production of the integrated barrier ribs 530 is explained below with reference to FIG. 11B. First, a rear portion 524 of the barrier rib 530 is formed on a front surface 221*a* of a rear substrate 222. Then, a space defined by the rear portion 524 is filled with a paste comprising a fluorescent material and dried and baked to obtain fluorescent layers 225. Next, first barrier rib layer 515*a* is formed on the rear portion 524 of the integrated barrier rib 530, and a rear discharge electrode 512 is formed on the first barrier rib layer 515*a*. The first barrier rib layer 515*a* does not have to be formed when the rear discharge electrode 512 contacts the rear portion 524 which defines the space in which the fluorescent layer 225 is coated.

Then, a second barrier rib layers 515*b* is formed to cover the rear discharge electrode 512, and a front discharge electrode 513 is formed on the second barrier rib layer 515*b*. Third barrier rib layer 515*c* is formed to cover the front discharge electrode 213. The first barrier rib layer 515*a*, the second barrier rib layer 515*b*, and the third barrier rib layer 515*c* constitute a front portion 515 of the integrated barrier rib 530. The rear portion 524, the first barrier rib layer 515*a*, the second barrier rib layer 515*b*, and the third barrier rib layer 515*c* can each comprise more than one layer, if necessary (for example, in order to increase their thicknesses).

After forming the integrated barrier rib 530, protective layers 216 are formed on at least sidewalls 515*g* of the front portion 524 of the integrated barrier rib 530, using deposition. During the deposition of the protective layers 216, rear protective layers (not shown) can also be formed on front surfaces 225*a* of the fluorescent layers 225. The function of the protective layers 216 is as described above.

During the deposition of the protective layers 216, a protective layer can be further formed on a front surface 530*h* of the in the integrated barrier rib 530. The protective layer formed on the front surface 530*h* does not have a great adverse effect on the operation of the PDP 500.

Figure 12B:
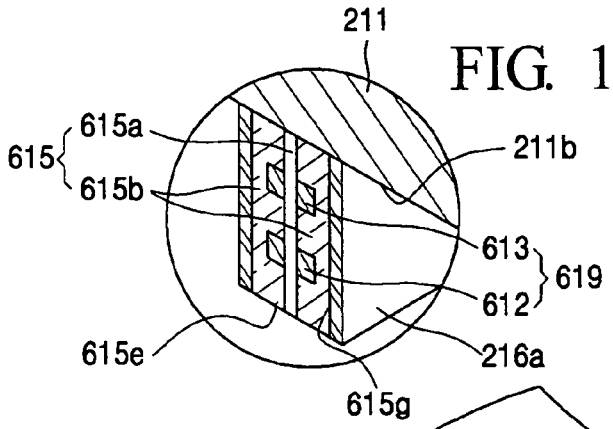
FIG. 12B is an expanded portion of FIG. 12A contained within the dotted circle thereof.
Figure 12A:
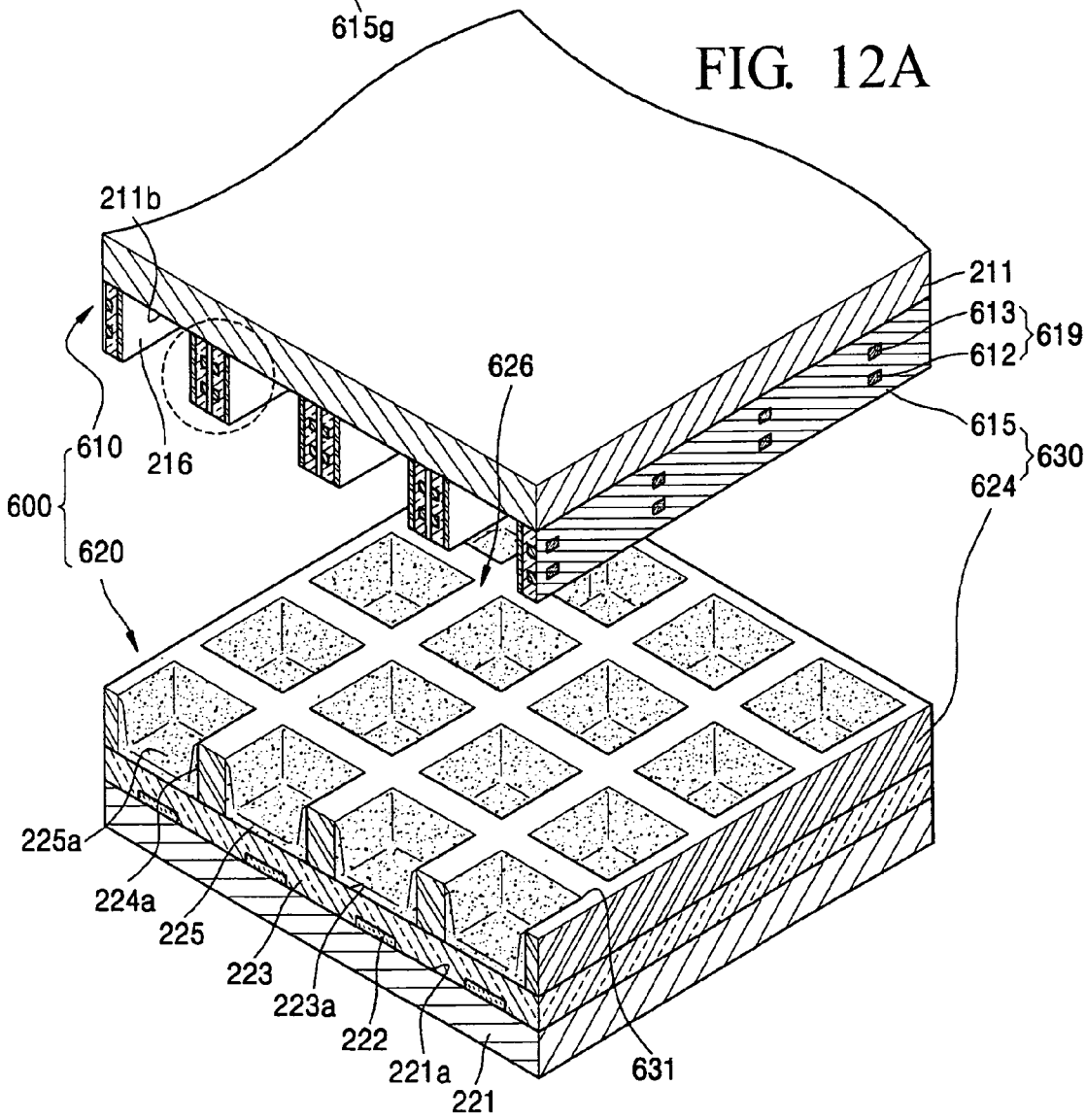
FIG. 12A is a partially cutaway exploded perspective view of a third modified example of the PDP of FIG. 7.
Figure 13:
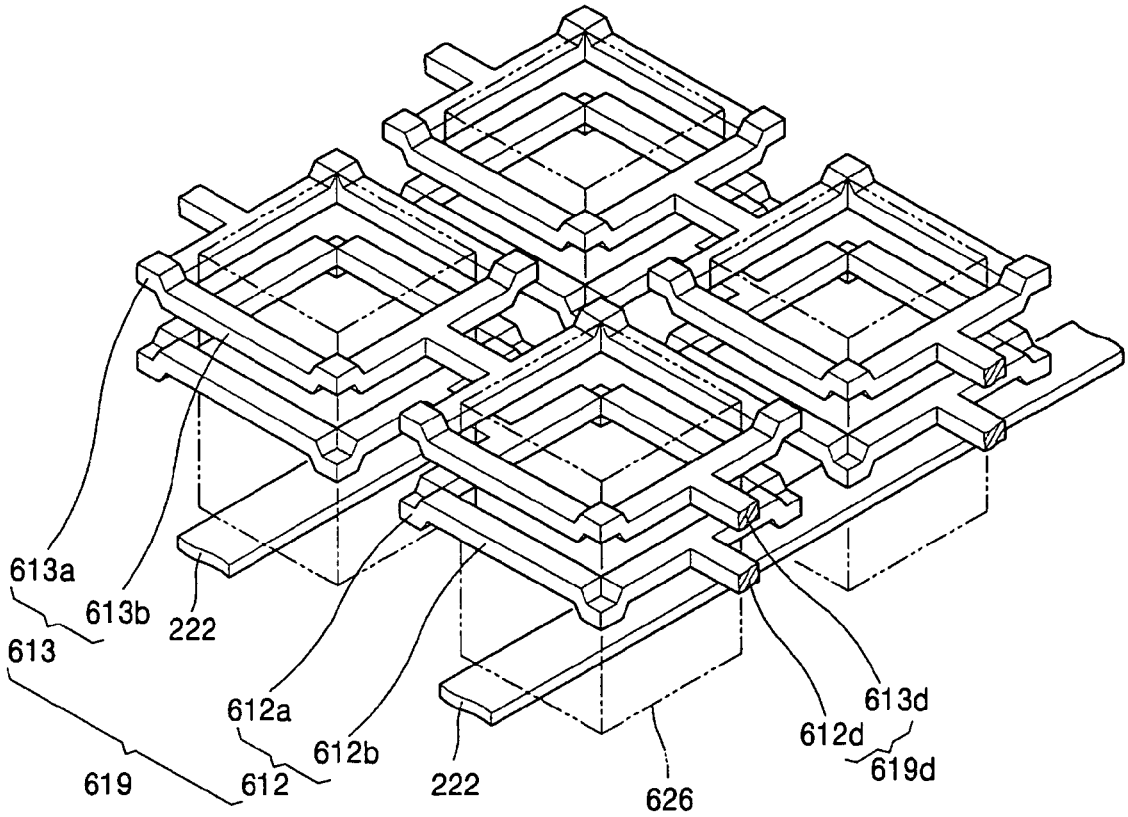
FIG. 13 is an exploded perspective view of discharge electrodes, discharge cells, and address electrodes of the PDP of FIG. 12.

FIGS. 12A and 12B is a partially cutaway exploded perspective view and a magnified view of a third modified example 600 of the PDP 300 of FIG. 7. FIG. 13 is an exploded perspective view of discharge electrodes 619, discharge cells 626, and address electrodes 222 of the PDP 600 of FIG. 12A. Referring to FIGS. 12A and 12B and 13, the PDP 600 is explained below based on the differences from the PDP 300 of FIG. 7.

The PDP 600 differs from the PDP 300 of FIG. 7 in the structures of front barrier ribs 615 and the discharge electrodes 619. The front barrier ribs 615 comprise center barrier ribs 615*a* and side barrier ribs 615*b* in order to prevent interference between the discharge cells 626 which can occur according to operation modes, reduce a watteless power occurring between connective portions 619*d* of the discharge electrodes 619, and allow for convenience of a manufacturing process of the barrier ribs 615.

The center barrier ribs 615*a* can be made of a material having a lower relative dielectric constant than a material of the side barrier ribs 615*b* to prevent the interference between the discharge cells 626 which can occur according to the operation modes.

Referring to FIG. 13, the position and shape of discharge electrodes 619 is explained as follows. To prevent a non-uniform discharge due to the concentration of the electric field in corner portions 631 of discharge cells 626, pairs of corner portions 613*a* and 612*a* of the discharge electrodes 619 are bent in such a direction that they are farther from each other, such that a distance $d_1$ between the corner portions 613*a* and 612*a* of the discharge electrodes 619 is greater than a distance $d_2$ between portions 613*b* and 612*b* of the discharge electrodes 619 other than the corner portions 613*a* and 612*a*, as in the PDP 300 of FIG. 7. The discharge electrodes 619 have connective portions 619*d* and extend in a predetermined direction.

Figure 14:
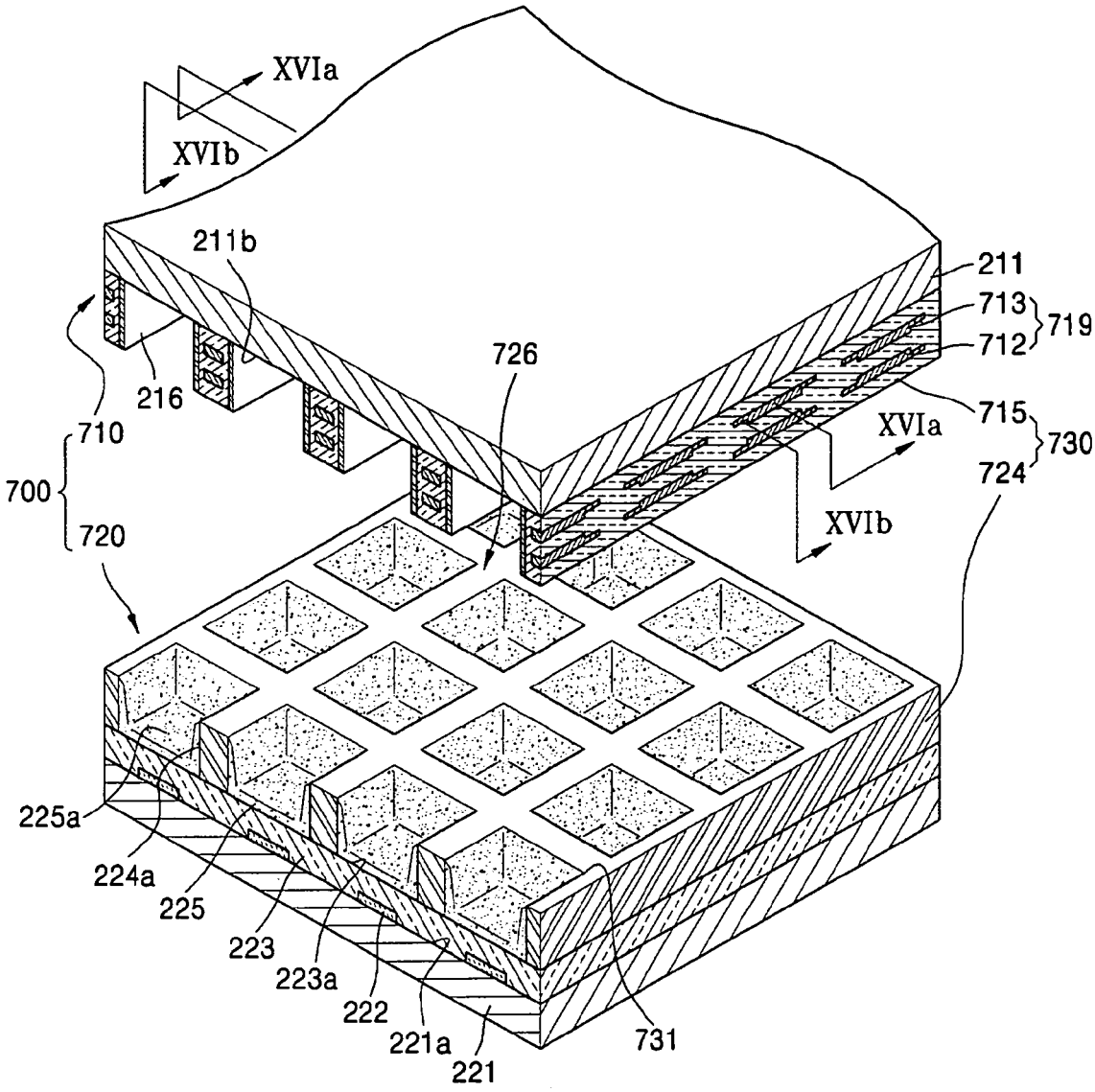
FIG. 14 is a partially cutaway exploded perspective view of a PDP according to another embodiment of the present invention.
Figure 15:
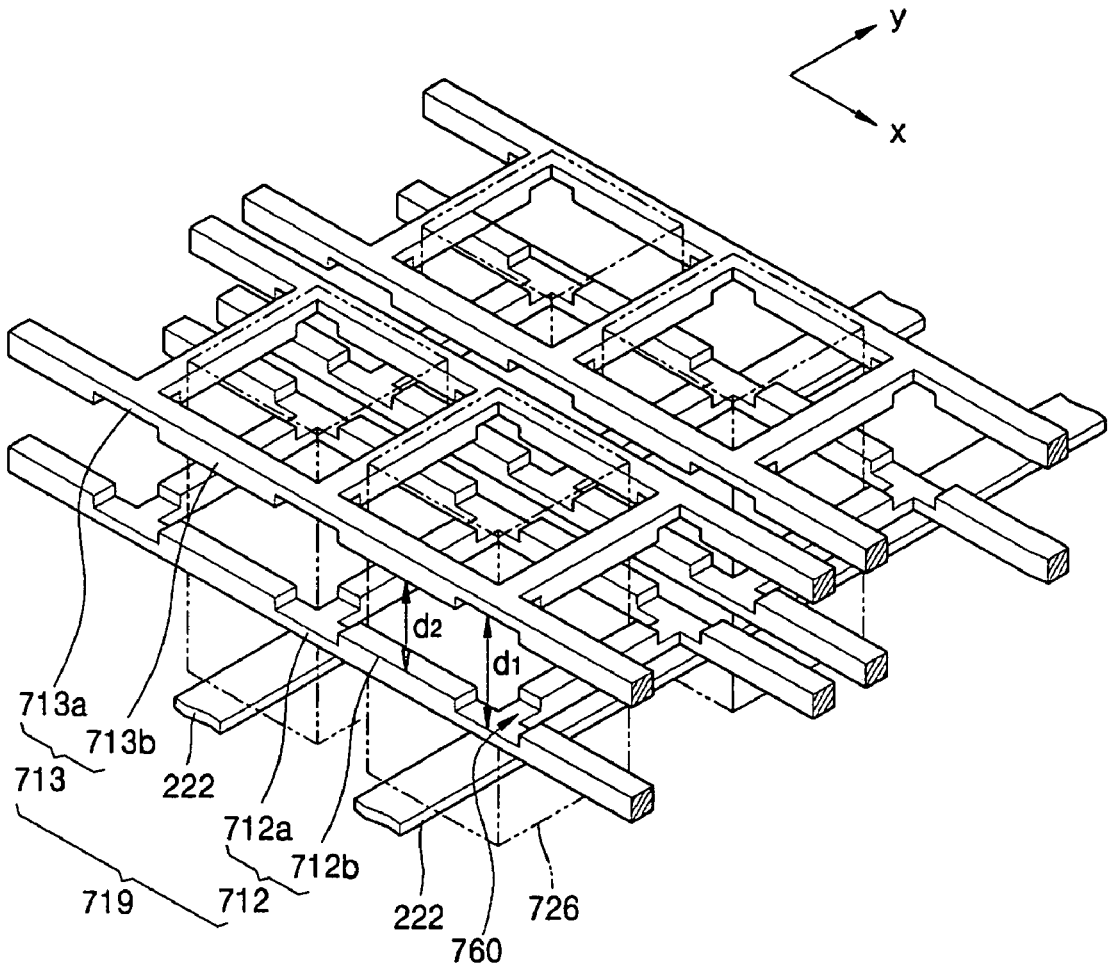
FIG. 15 is an exploded perspective view of discharge electrodes, address electrodes, and discharge cells of the PDP of FIG. 14.
Figure 16A:
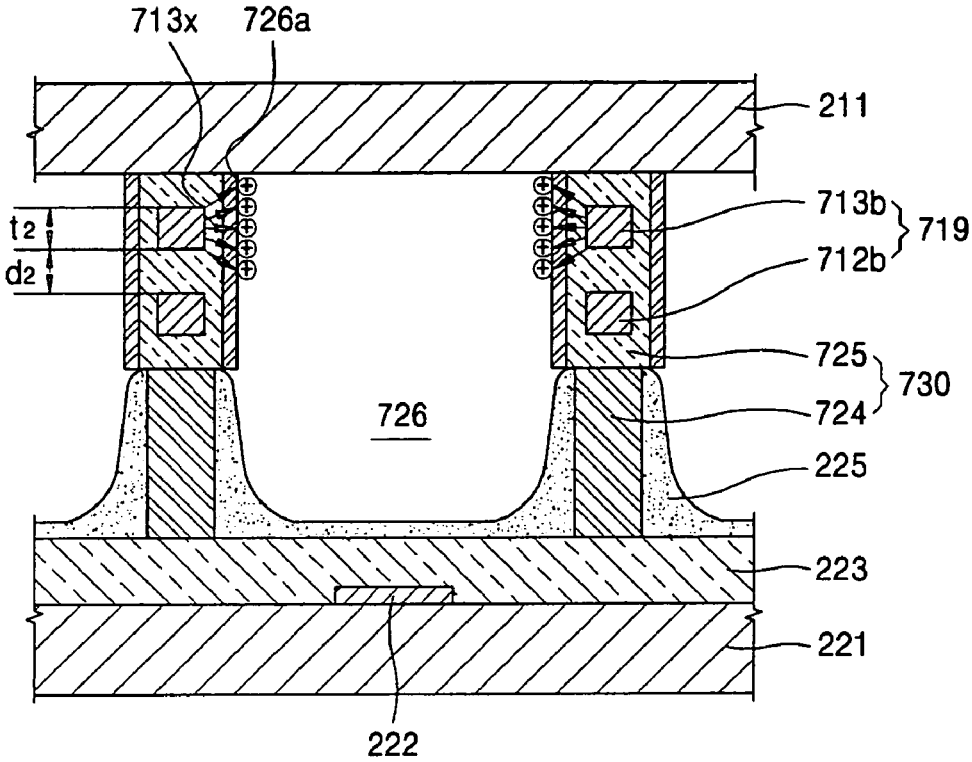
FIG. 16A is a cross-sectional view taken along line XVIa-XVIa of the PDP of FIG. 14.
Figure 16B:
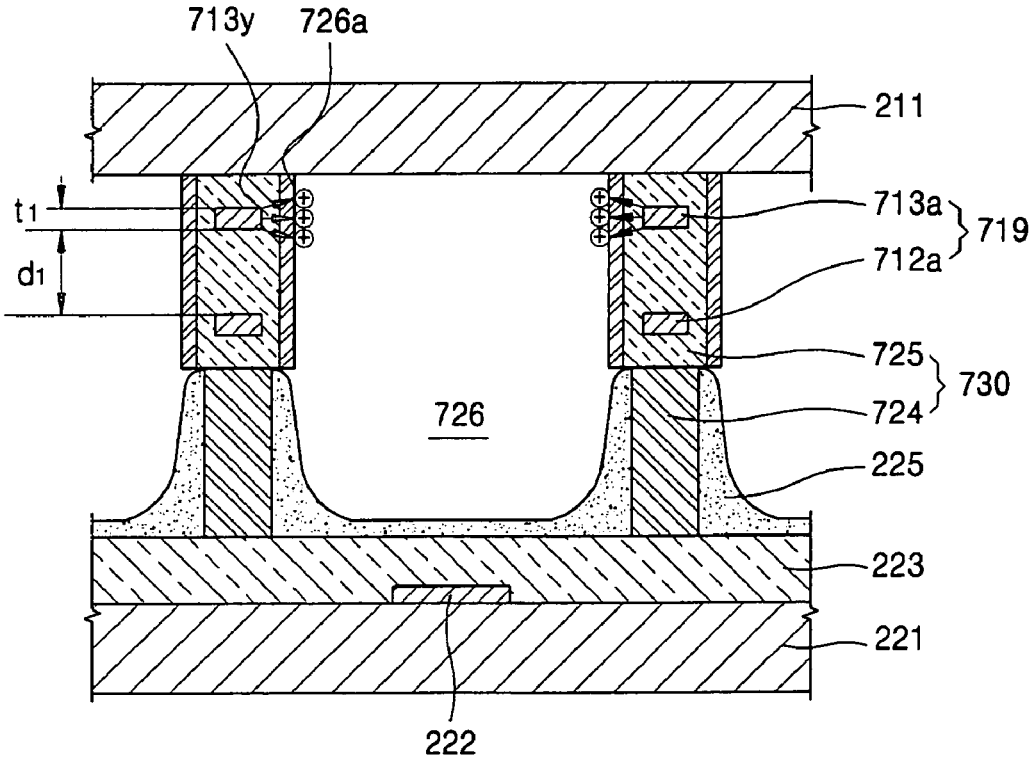
FIG. 16B is a cross-sectional view taken along line XVIb-XVIB cutting corner portions of the PDP of FIG. 14.

FIG. 14 is a partially cutaway exploded perspective view of a PDP 700 according to another embodiment of the present invention. FIG. 15 is an exploded perspective view of discharge electrodes 719, address electrodes 222, and discharge cells 726 of the PDP 700 of FIG. 14. FIG. 16A is a cross-sectional view taken along line XVIa-XVIa of the PDP 700 of FIG. 14. FIG. 16B is a cross-sectional view taken along line XVIb-XVIb cutting corner portions 731 of the PDP 700 of FIG. 14. Referring to FIGS. 14, 15, 16A, and 16B, the PDP 700 is explained below based on the differences from the PDP 300 of FIG. 7.

The PDP 700 differs from the PDP 300 of FIG. 7 in the shape of corner portions 713*a* and 712*a* of discharge electrodes 719. As described above, a strength of an electric field generated due to a voltage supplied between two electrodes is proportional to a voltage difference between the two electrodes divided by a distance between the two electrodes. Thus, when the distance between the two electrodes is increased, the electric field strength between the two electrodes is decreased.

Referring to FIGS. 14 and 15, pairs of the corner portions 713*a* and 712*a* of front discharge electrodes 713 and rear discharge electrodes 712, the corner portions 713*a* and 712*a* facing each other, have concave portions 760 on their facing surfaces, and thus a distance $d_1$ between the corner portions 713*a* and 712*a* of the discharge electrodes 719 is greater than a distance $d_2$ between portions 713*b* and 712*b* of the discharge electrodes 719 other than the corner portions 713*a* and 712*a*. Thus, a strength of an electric field generated between the pairs of the corner portions 713*a* and 712*a* is less than a strength of an electric field generated between portions 713*b* and 712*b* of the discharge electrodes 719 other than the corner portions 713*a* and 712*a*. As a result, the concentration of the electric field in the corner portions 731 of the discharge cells 726 can be reduced and the discharge can uniformly occur.

It is not necessary to form the concave portions 760 on both the facing surfaces of each of the pairs of the corner portions 713*a* and 712*a*. In the present embodiment, the concave portions 760 can be formed on one of the facing surfaces of each of the pairs of the corner portions 713*a* and 712*a*.

Referring to FIGS. 16A and 16B, when a pair of corner portions 713*a* and 712*a* of a discharge electrode 719 has concave portions 760 on their facing surfaces, as described above, a thickness $t_1$ of each of the corner portions 713*a* and 712*a* of the discharge electrode 719 is less than a thickness $t_2$ of each of portions 713*b* and 712*b* of the discharge electrode 719 other than the corner portions 713*a* and 712*a*. When a voltage is supplied between the corner portions 713*a* and 712*a* of the discharge electrode 719, an electric field is generated and an electric power due to the electric field induces wall charges on inner surfaces of a discharge cell 726.

An electric power is inversely proportional to the square of a distance, and thus, the wall charges induced by the electric power generated at edges 713*x* of the discharge electrode 719 are formed on a limited area of the inner surfaces of the discharge cell 726. Since $t_1$ is less than $t_2$, the wall charges induced by the corner portions 713*a* and 712*a* of the discharge electrodes 719 are formed on a narrower area in the inner surfaces of the discharge cells 726 than the wall charges induced by the portions 713*b* and 712*b* of the discharge electrode 719 other than the corner portions 713*a* and 712*a*. As a result, the amount of the wall charges induced by the corner portions 713*a* and 712*a* is reduced.

As the thickness $t_1$ of each of the corner portions 713*a* and 712*a* of the discharge electrode 719 is decreased, the amount of the wall charges induced on the corner portions 731 of the discharge cell 726 is decreased. Thus, a probability that a discharge occurs on the corner portions 731 of the discharge cell 726 is reduced.

Thus, when the pairs of the corner portions 713*a* and 712*a* of the discharge cell 726 have the concave portions 760 on their facing surfaces, the distance $d_1$ between the corner portions 713*a* and 712*a* is increased and the thickness $t_1$ of each of the corner portions 713*a* and 712*a* of the discharge electrode 719 is decreased. Thus, the concentration of the discharge on the corner portion 731 of the discharge cell 726 can be reduced.

Figure 17:
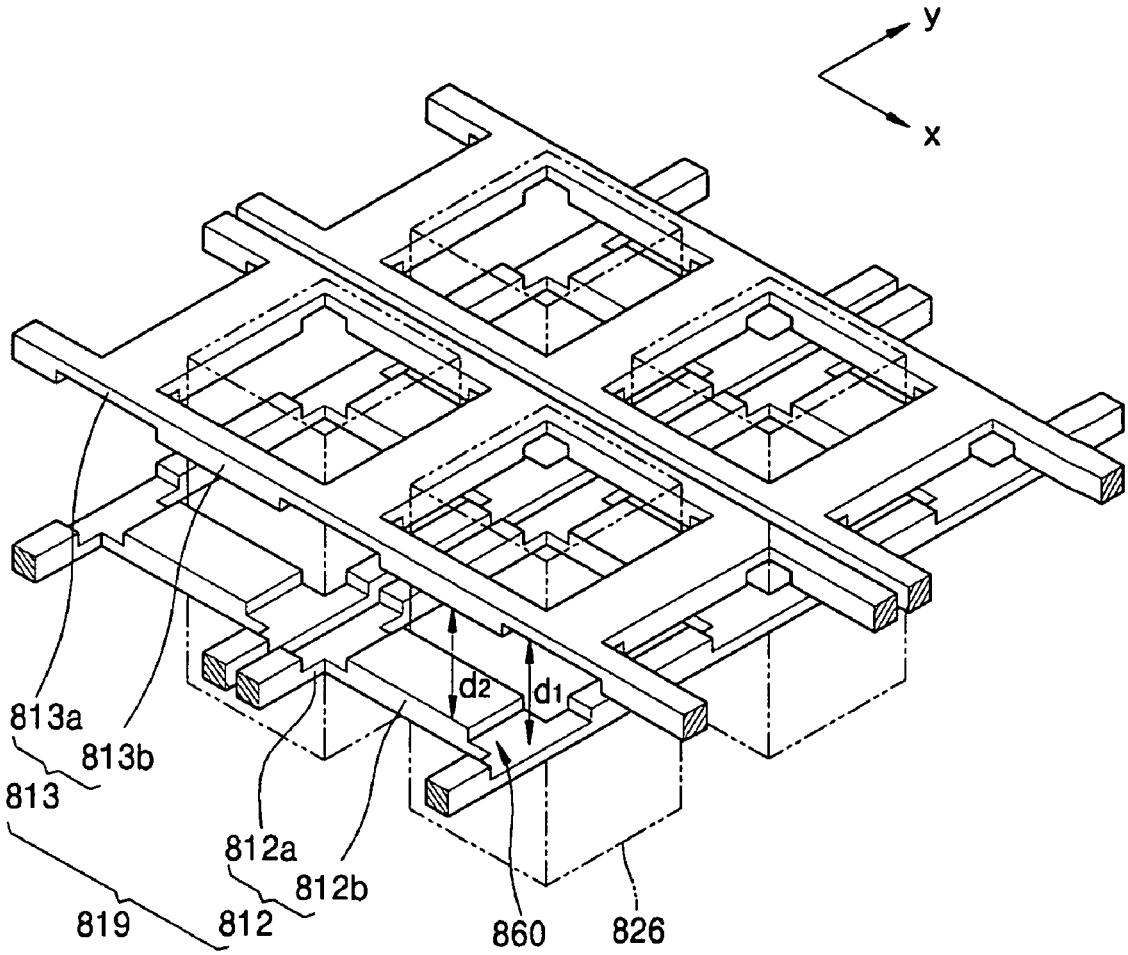
FIG. 17 is a partially cutaway exploded perspective view of discharge electrodes and discharge cells of a first modified example of the PDP of FIG. 14.

FIG. 17 is an exploded perspective view of discharge electrodes 819 and discharge cells 826 of a first modified example of the PDP 700 of FIG. 14. Referring to FIG. 17, the PDP is explained below based on the differences from the PDP 700 of FIG. 14.

Referring to FIG. 17, the PDP does not comprise address electrodes 222, like the PDP 400 of FIG. 9. An address discharge for selecting one of the discharge cells 826 is performed by the discharge electrodes 819 and a sustain discharge for realizing images is performed by the discharge electrodes 819.

In the PDP of FIG. 17, pairs of corner portions 813*a* and 812*a* of the discharge electrodes 819 have concave portions 860 on their facing surfaces as in the PDP 700 of FIG. 14, and thus, a distance $d_1$ between the corner portions 813*a* and 812*a* of the discharge electrodes 819 is greater than a distance $d_2$ between portions 813*b* and 812*b* of the discharge electrodes 819 other than the corner portions 813*a* and 812*a*. As a result, the concentration of the electric field in corner portions of the discharge cells 826 can be reduced and the discharge can uniformly occur in the discharge electrodes 819.

Figure 18:
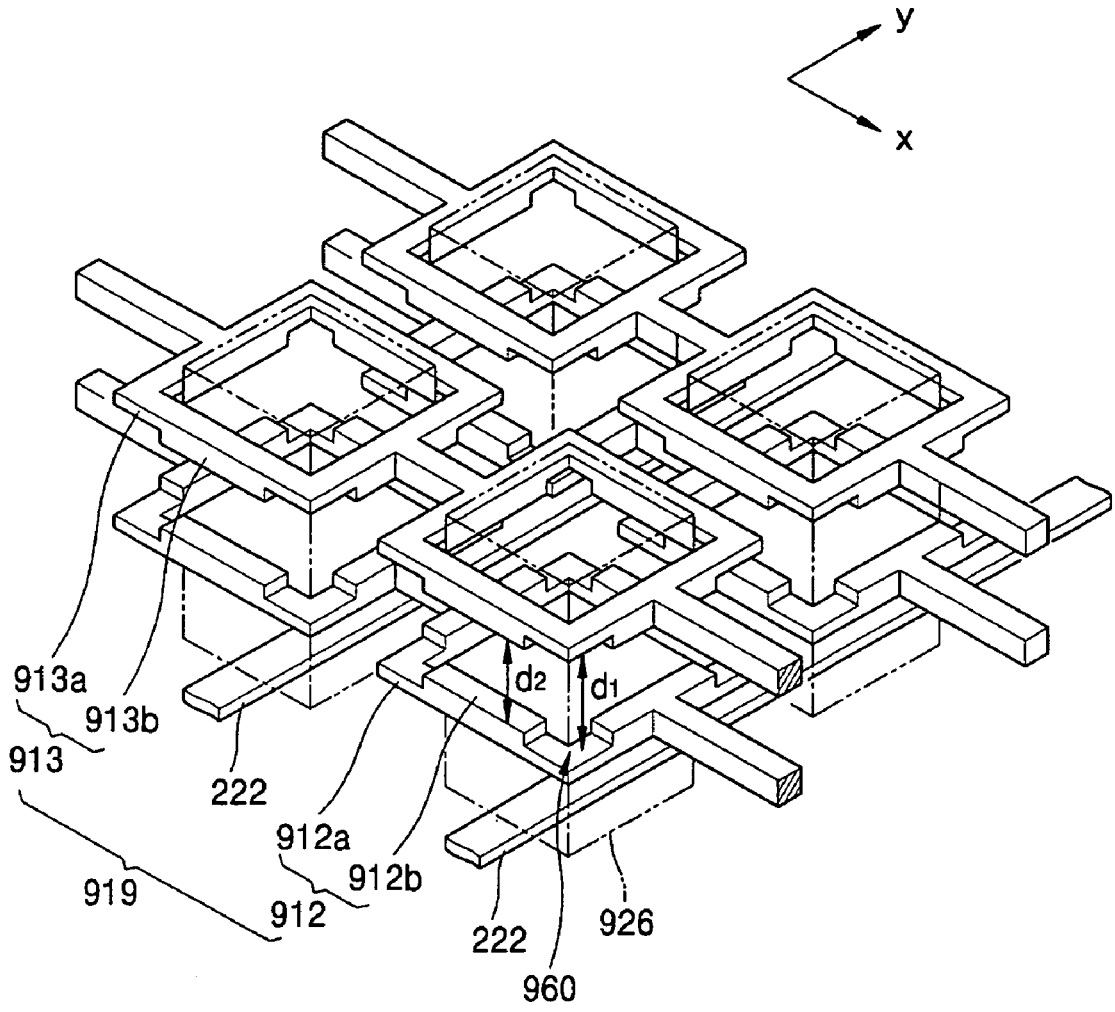
FIG. 18 is an exploded perspective view of discharge electrodes, discharge cells, and address electrodes of a second modified example of the PDP of FIG. 14.

FIG. 18 is an exploded perspective view of discharge electrodes 919, discharge cells 926, and address electrodes 222 of a second modified example of the PDP 700 of FIG. 14. The PDP of FIG. 18 is different from the PDP 600 of FIG. 13 in the shape of discharge electrodes.

Referring to FIG. 18, pairs of corner portions 913*a* and 912*a* of the discharge electrodes 919 have concave portions 960 on their facing surfaces as in the PDP 700 illustrated in FIG. 14. As a result, the concentration of the electric field in corner portions of the discharge cells 926 can be reduced and the discharge can uniformly occur in the discharge electrodes 919.

In the PDP of FIG. 18, the discharge electrodes 919 do not have a ladder shape, as in the PDP 700 of FIG. 14, but have such a shape that they are extended through connective portions.

Figure 19:
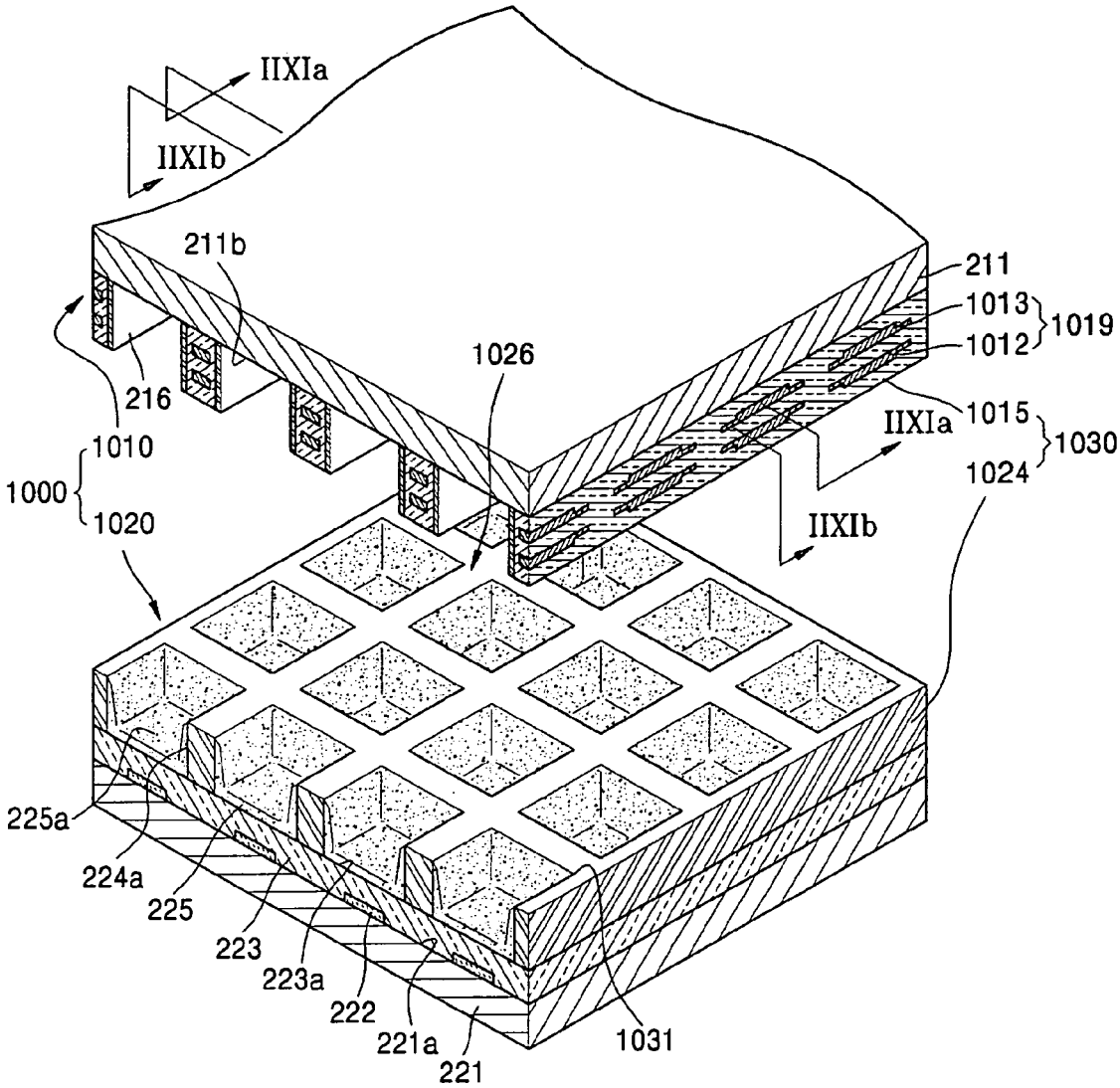
FIG. 19 is a partially cutaway exploded perspective view of a PDP according to still another embodiment of the present invention.
Figure 20:
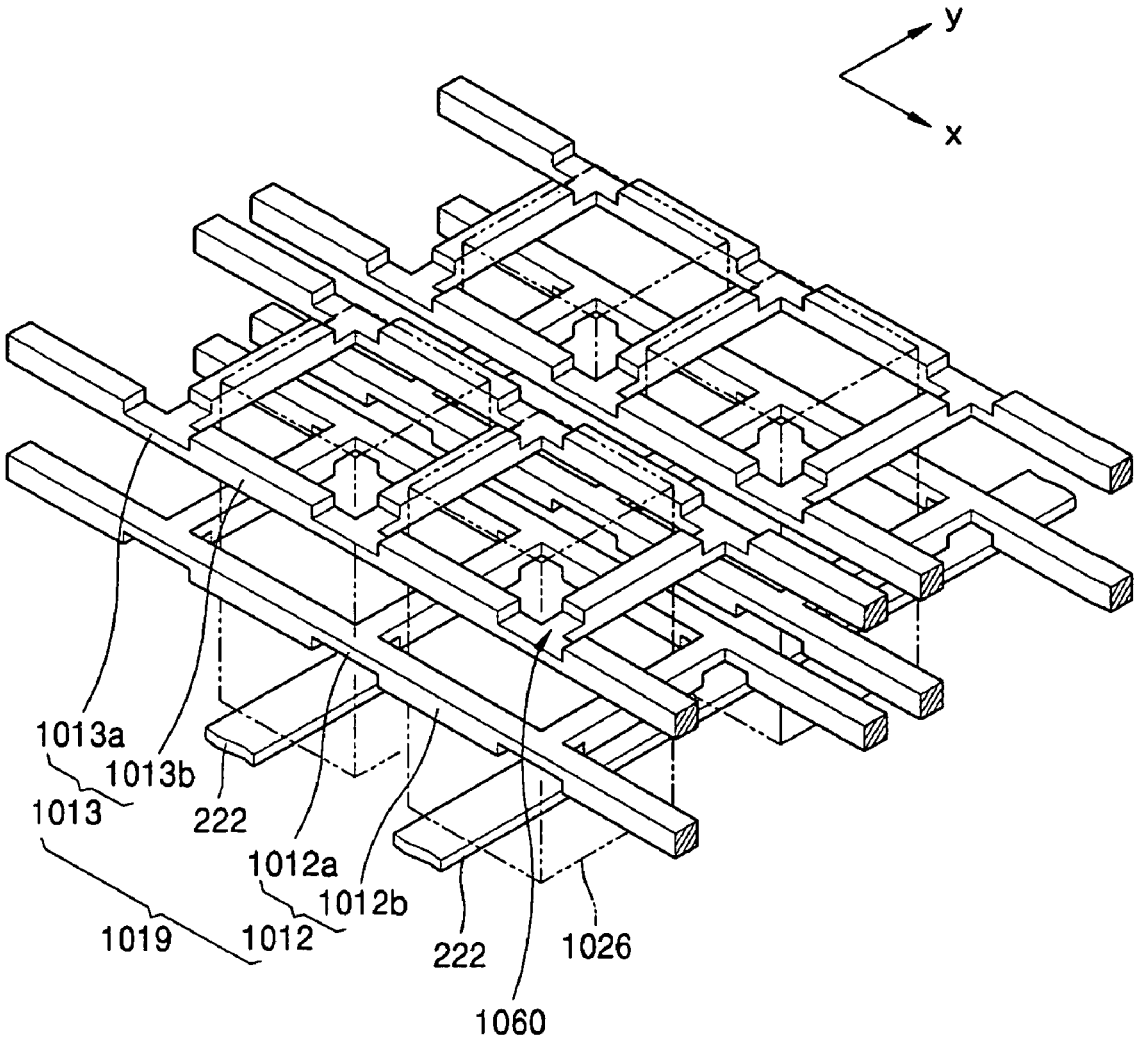
FIG. 20 is an exploded perspective view of discharge electrodes, discharge cells, and address electrodes of the PDP of FIG. 19.
Figure 21A:
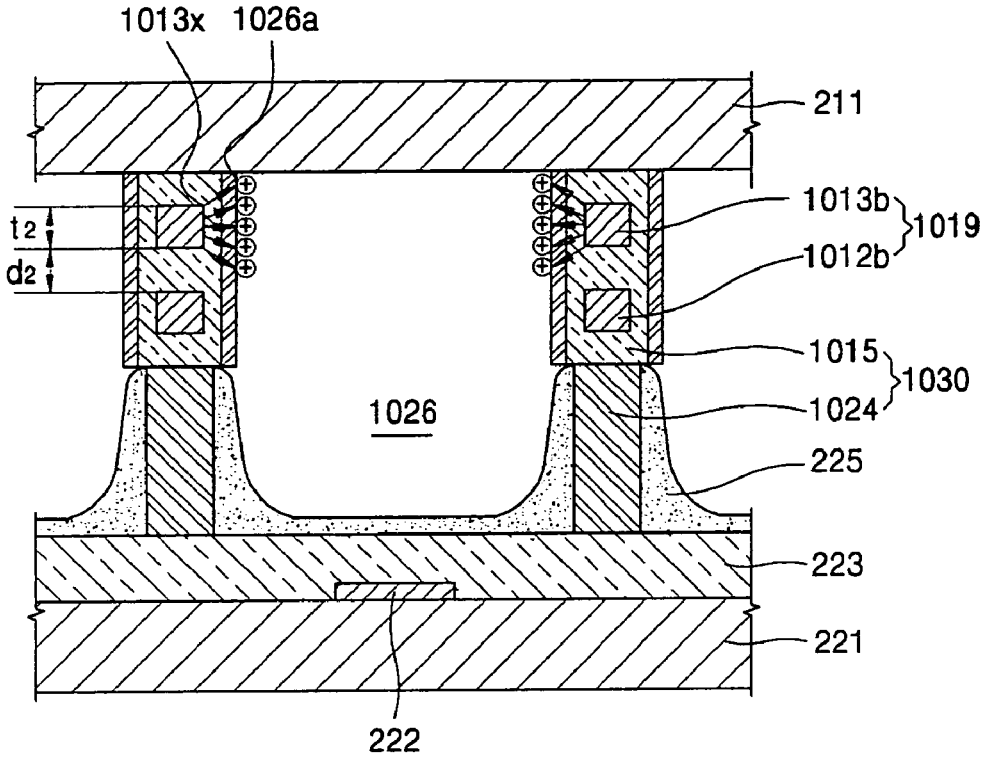
FIG. 21A is a cross-sectional view taken along line IIXIa-IIXIa of the PDP of FIG. 19.
Figure 21B:
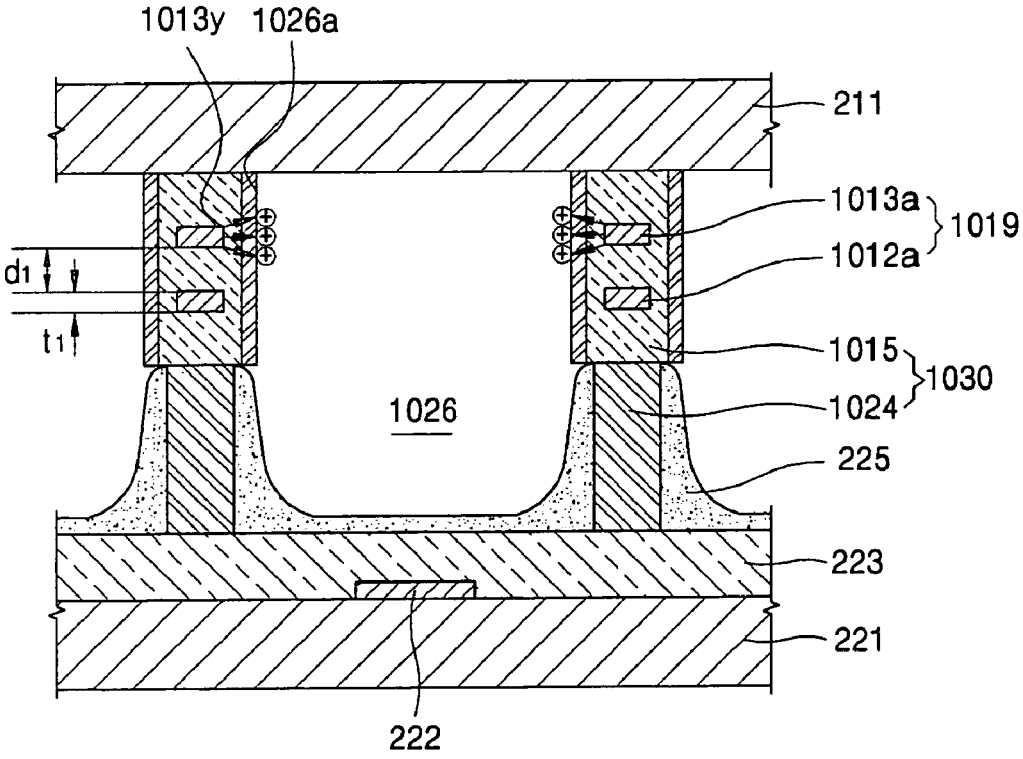
FIG. 21B is a cross-sectional view taken along line IIXIb-IIXIb cutting corner portions of the PDP of FIG. 19.

FIG. 19 is a partially cutaway exploded perspective view of a PDP 1000 according to still another embodiment of the present invention. FIG. 20 is an exploded perspective view of discharge electrodes 1019, discharge cells 1026, and address electrodes 222 of the PDP 1000 of FIG. 19. FIG. 21A is a cross-sectional view taken along line IIXIa-IIXIa of the PDP 1000 of FIG. 19. FIG. 21B is a cross-sectional view taken along line IIXIb-IIXIb cutting corner portions 1031 of the PDP 1000 of FIG. 19. Referring to FIGS. 19, 20, 21A and 21B, the PDP 1000 is explained below based on the differences from the PDP 300 of FIG. 7.

In the PDP 1000, pairs of corner portions 1013*a* and 1012*a* of the discharge electrodes 1019 have concave portions 1060 on surfaces other than the facing surfaces. In this case, although a distance between the corner portions 1013*a* and 1012*a* of the discharge electrodes 1019 is identical to a distance between portions 1013*b* and 1012*b* of the discharge electrodes 1019 other than the corner portions 1013*a* and 1012*a*, a thickness of each of the corner portions 1013*a* and 1012*a* of the discharge electrode 1019 is less than a thickness of each of the portions 1013*b* and 1012*b* of the discharge electrode 1019 other than the corner portions 1013*a* and 1012*a*.

Referring to FIGS. 21A and 21B, as explained with respect to the PDP 700 of FIG. 1114, an electric power is inversely proportional to the square of a distance, and thus, the wall charges induced by the electric power generated at edges 1013*x* of the discharge electrode 1019 are formed on limited areas of inner surfaces 1026*a* of the discharge cell 1026.

Since a thickness $t_1$ of each of corner portions 1013*a* and 1012*a* of the discharge electrode 1019 is less than a thickness $t_2$ of each of portions 1013*b* and 1012*b* of the discharge electrode 1019 other than the corner portions 1013*a* and 1012*a*, the wall charges induced by the corner portions 1013*a* and 1012*a* of the discharge electrodes 1019 are formed on a narrower area in the inner surfaces of the discharge cells 1026 than the wall charges induced by the portions 1013*b* and 1012*b*. As a result, the amount of the wall charges induced by the corner portions 1013*a* and 1012*a* of the discharge electrodes 1019 is reduced.

Although a distance between the corner portions 1013*a* and 1012*a* of the discharge electrodes 1019 is identical to a distance between portions 1013*b* and 1012*b* of the discharge electrodes 1019 other than the corner portions 1013*a* and 1012*a*, when a thickness of each of the corner portions 1013*a* and 1012*a* of the discharge electrode 1019 is less than a thickness of each of the portions 1013*b* and 1012*b* of the discharge electrode 1019 other than the corner portions 1013*a* and 1012*a*, the amount of the wall charges on the corner portions 1031 of a discharge cell 1026 is reduced. Thus, a probability that a discharge occurs on the corner portions 1031 of the discharge cell 1026 is reduced. As a result, the discharge is less concentrated in the corner portion 1031 of the discharge cell 1026 and the discharge can uniformly occur along the inner sidewalls of the discharge cell 1026.

Figure 22:
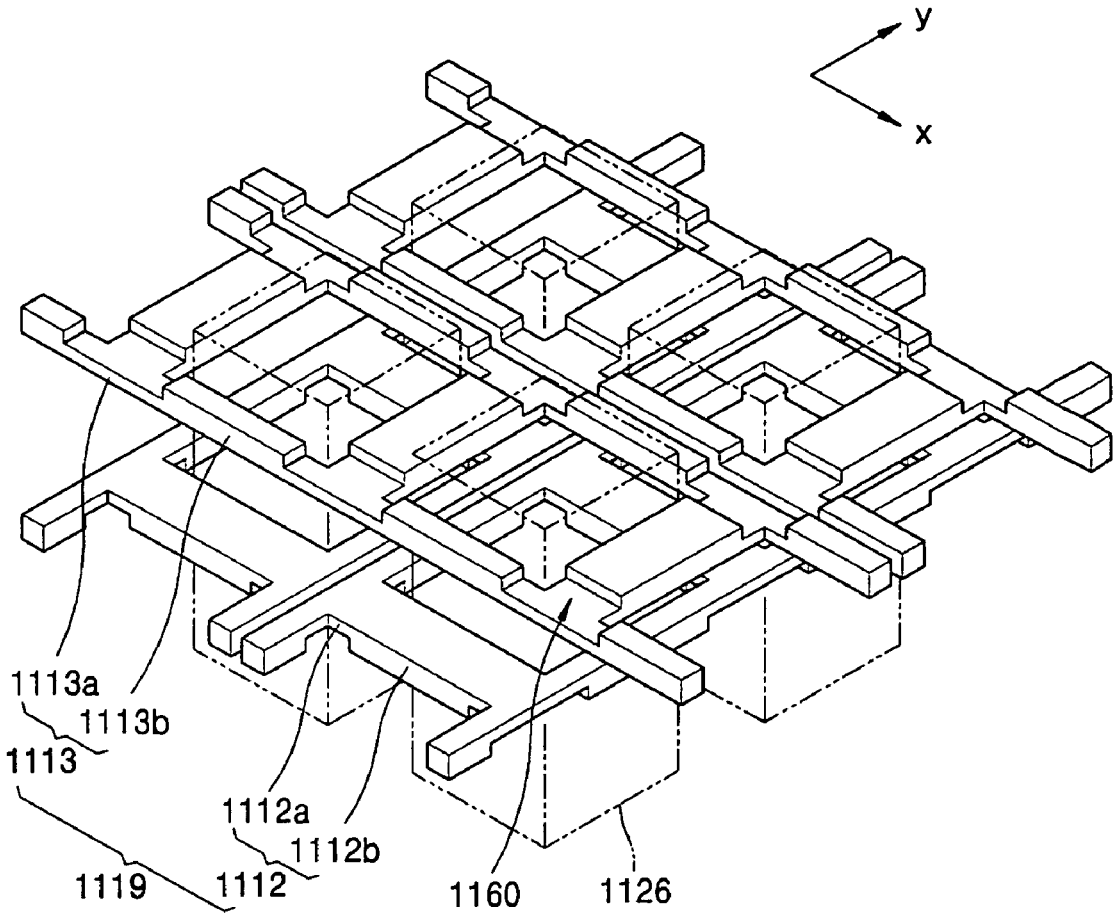
FIG. 22 is an exploded perspective view of discharge electrodes and discharge cells of a first modified example of the PDP of FIG. 19.

FIG. 22 is an exploded perspective view of discharge electrodes 1119 and discharge 11 cells 1126 of a first modified example of the PDP 1000 of FIG. 19.

Referring to FIG. 22, address electrodes 222 are not present and pairs of corner portions 1113*a* and 1112*a* of the discharge electrodes 1119 have concave portions 1160 on surfaces other than the facing surfaces. As a result, the discharge is less concentrated in the corner portions 1113*a* and 1112*a* of discharge cells 1126.

Figure 23:
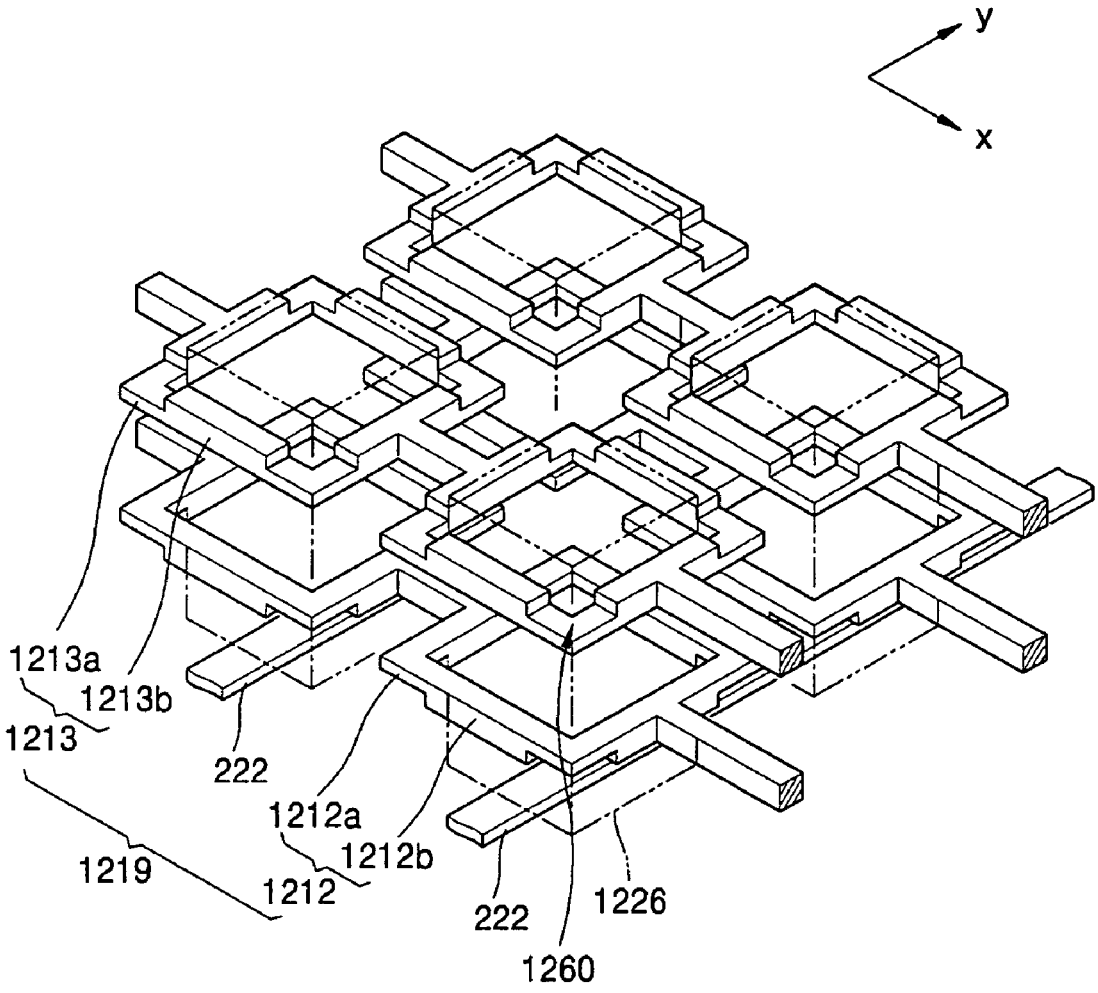
FIG. 23 is an exploded perspective view of discharge electrodes, discharge cells, and address electrodes of a second modified example of the PDP of FIG. 19.

FIG. 23 is an exploded perspective view of discharge electrodes 1219, discharge cells 1226, and address electrodes 222 of a second modified example of the PDP 1000 of FIG. 19. In this case, barrier ribs are modified to comprise center barrier ribs and side barrier ribs.

Referring to FIG. 23, pairs of corner portions 1213*a* and 1212*a* of the discharge electrodes 1219 have concave portions 1260 on surfaces other than the facing surfaces. As a result, the discharge is less concentrated in the corner portions 1213*a* and 1212*a* of discharge cells 1226.

Figure 24:
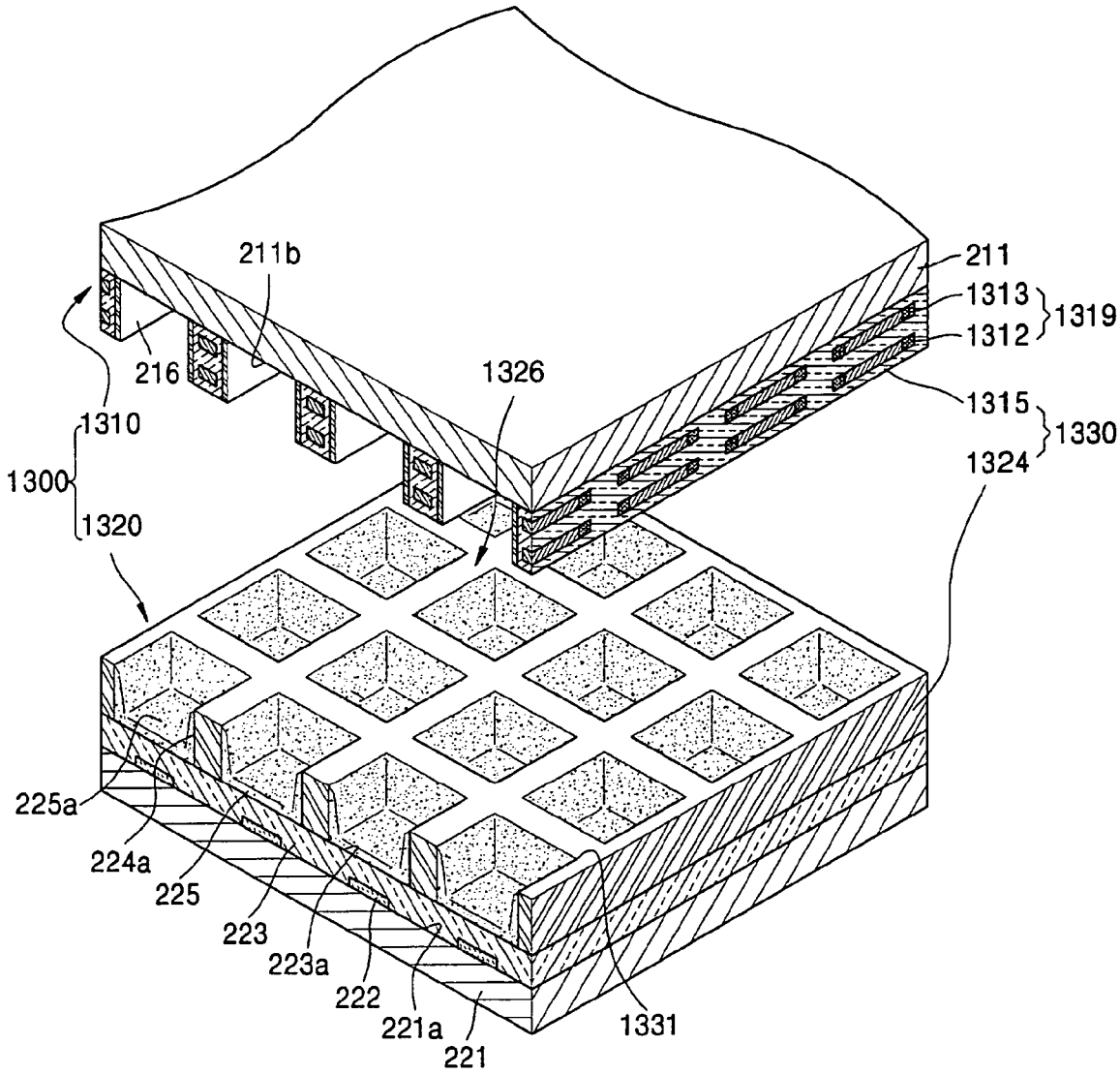
FIG. 24 is a partially cutaway exploded perspective view of a PDP according to yet another embodiment of the present invention.
Figure 25:
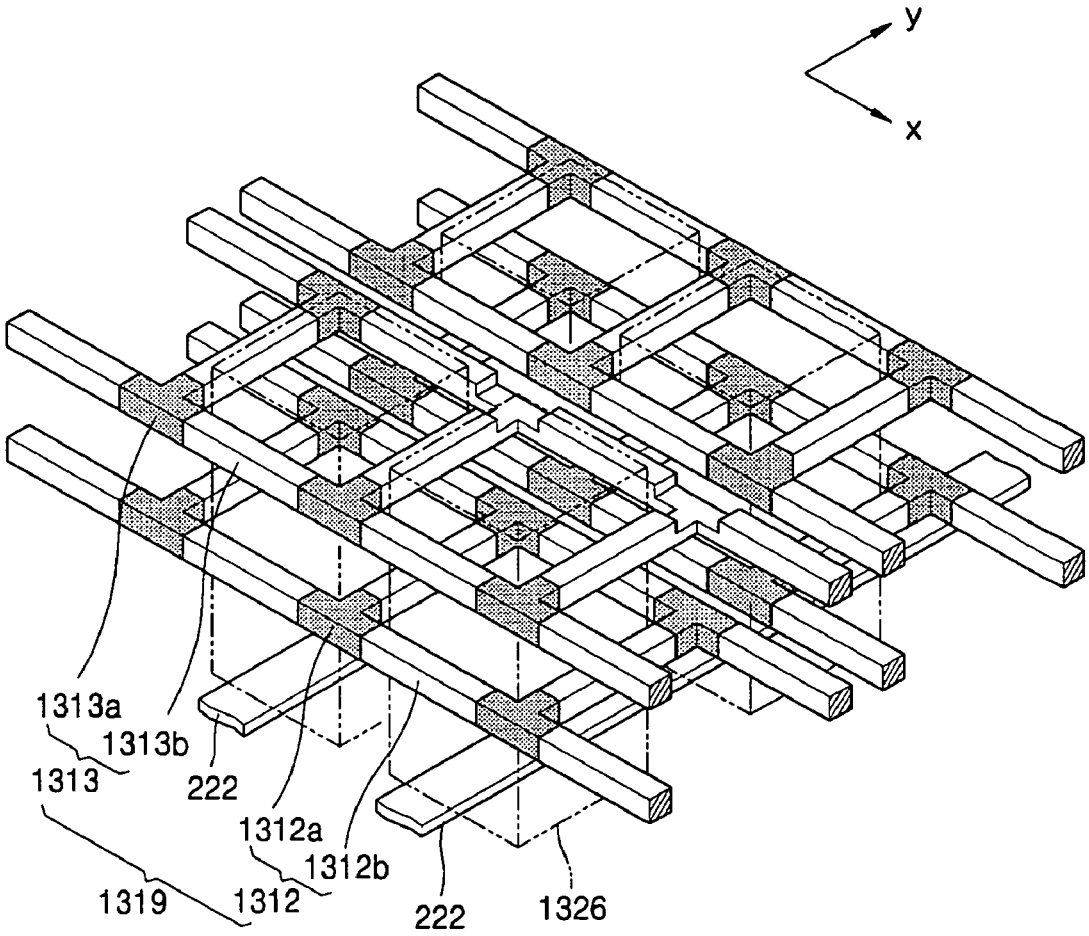
FIG. 25 is an exploded perspective view of discharge electrodes, discharge cells, and address electrodes of the PDP of FIG. 24.

FIG. 24 is a partially cutaway exploded perspective view of a PDP 1300 according to yet another embodiment of the present invention. FIG. 25 is an exploded perspective view of discharge electrodes 1319, discharge cells 1326, and address electrodes 222 of the PDP 1300 of FIG. 24. Referring to FIGS. 24 and 25, the PDP 1300 is explained below based on the differences from the PDP 300 of FIG. 7.

The PDP 1300 differs from the PDP 300 of FIG. 7 in that corner portions 1313*a* and 1312*a* of the discharge electrodes 1319 have a higher resistivity than portions 1313*b* and 1312*b* of the discharge electrode 1319 other than the corner portions 1313*a* and 1312*a*.

As described with respect to the PDP 300 of FIG. 7, a strength of an electric field generated due to a voltage supplied between two electrodes is proportional to a voltage difference between the two electrodes divided by a distance between the two electrodes.

When the voltage is supplied between the discharge electrodes 1319, the discharge electrodes 1319 have resistance and a voltage drop occurs although the discharge electrodes 1319 are made of a conductive material. When the corner portions 1313*a* and 1312*a* of the discharge electrodes 1319 are made of a material having a high resistivity, a voltage drop occurring in the corner portions 1313*a* and 1312*a* of the discharge electrodes 1319 is relatively greater than a voltage drop in the portions 1313*b* and 1312*b* of the discharge electrode 1319 other than the corner portions 1313*a* and 1312*a*. As a result, a voltage difference between the corner portions 1313*a* and 1312*a* of the discharge electrodes 1319 is less than a voltage difference between the portions 1313*b* and 1312*b* of the discharge electrode 1319 other than the corner portions 1313*a* and 1312*a*.

Although a distance between the corner portions 1313*a* and 1312*a* of the discharge electrodes 1319 is identical to a distance between the portions 1313*b* and 1312*b* of the discharge electrodes 1319 other than the corner portions 1313*a* and 1312*a*, since the voltage difference between the corner portions 1313*a* and 1312*a* of the discharge electrodes 1319 is less than the voltage difference between the portions 1313*b* and 1312*b* of the discharge electrode 1319 other than the corner portions 1313*a* and 1312*a*, a strength of an electric field generated between the pairs of the corner portions 1313*a* and 1312*a* is less than a strength of an electric field generated between portions 1313*b* and 1312*b* of the discharge electrodes 1319 other than the corner portions 1313*a* and 1312*a*. As a result, the discharge is less concentrated in the corner portion 1331 of the discharge cell 1326 and the discharge can uniformly occur on inner sidewalls of the discharge cell 1326.

Figure 26:
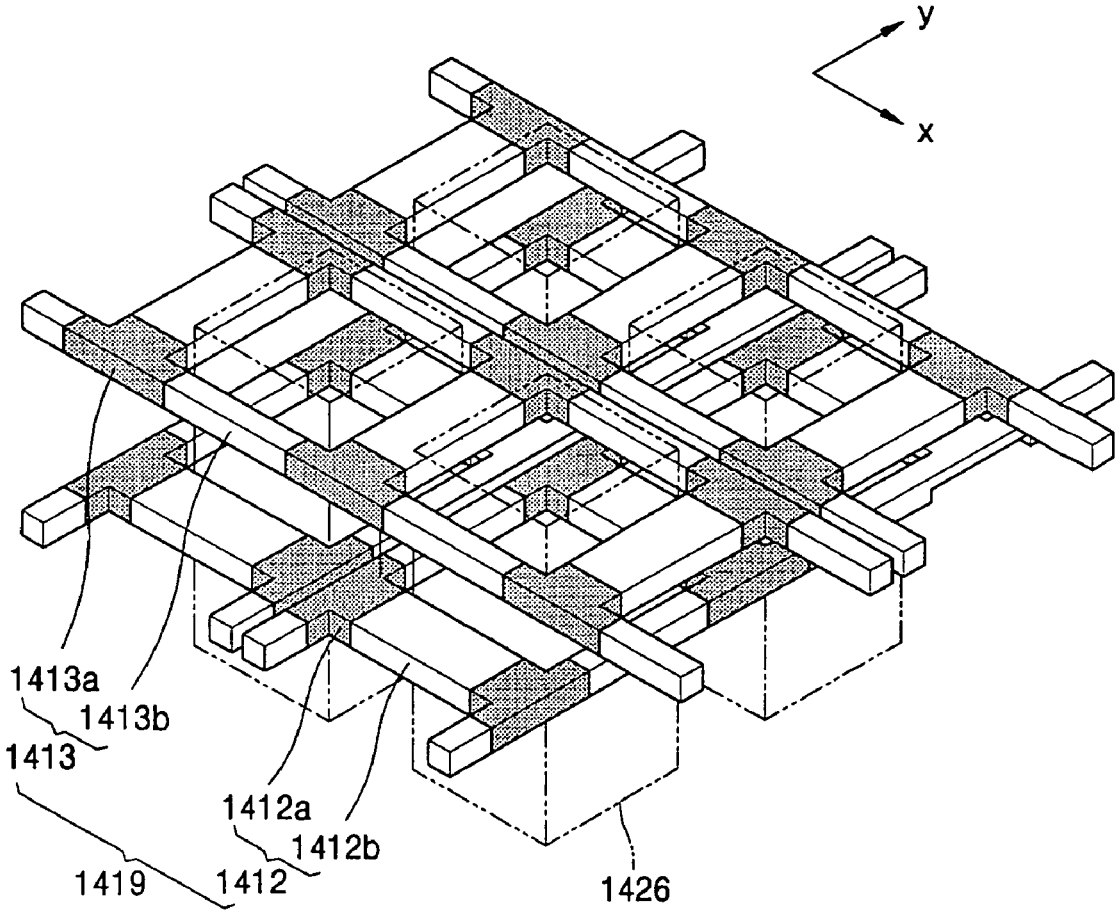
FIG. 26 is an exploded perspective view of discharge electrodes and discharge cells of a first modified example of the PDP of FIG. 24.

FIG. 26 is an exploded perspective view of discharge electrodes 1419 and discharge cells 1426 of a first modified example of the PDP 1300 of FIG. 24. Referring to FIG. 26, the PDP is explained below based on the differences from the PDP 1300 of FIG. 24.

Referring to FIG. 26, address electrodes 222 are not present, as in the PDP 400 of FIG. 9. An address discharge for selecting one of the discharge cells 1426 and a sustain discharge for realizing images are performed by the discharge electrodes 1419. To prevent the discharge from concentrating in corner portions of the discharge cells 1426, corner portions 1413*a* and 1412*a* of the discharge electrodes 1419 are made of a material having a higher resistivity than portions 1413*b* and 1412*b* of the discharge electrodes 1419 other than the corner portions 1413*a* and 1412*a*, as in the PDP 1300 of FIG. 24.

Figure 27:
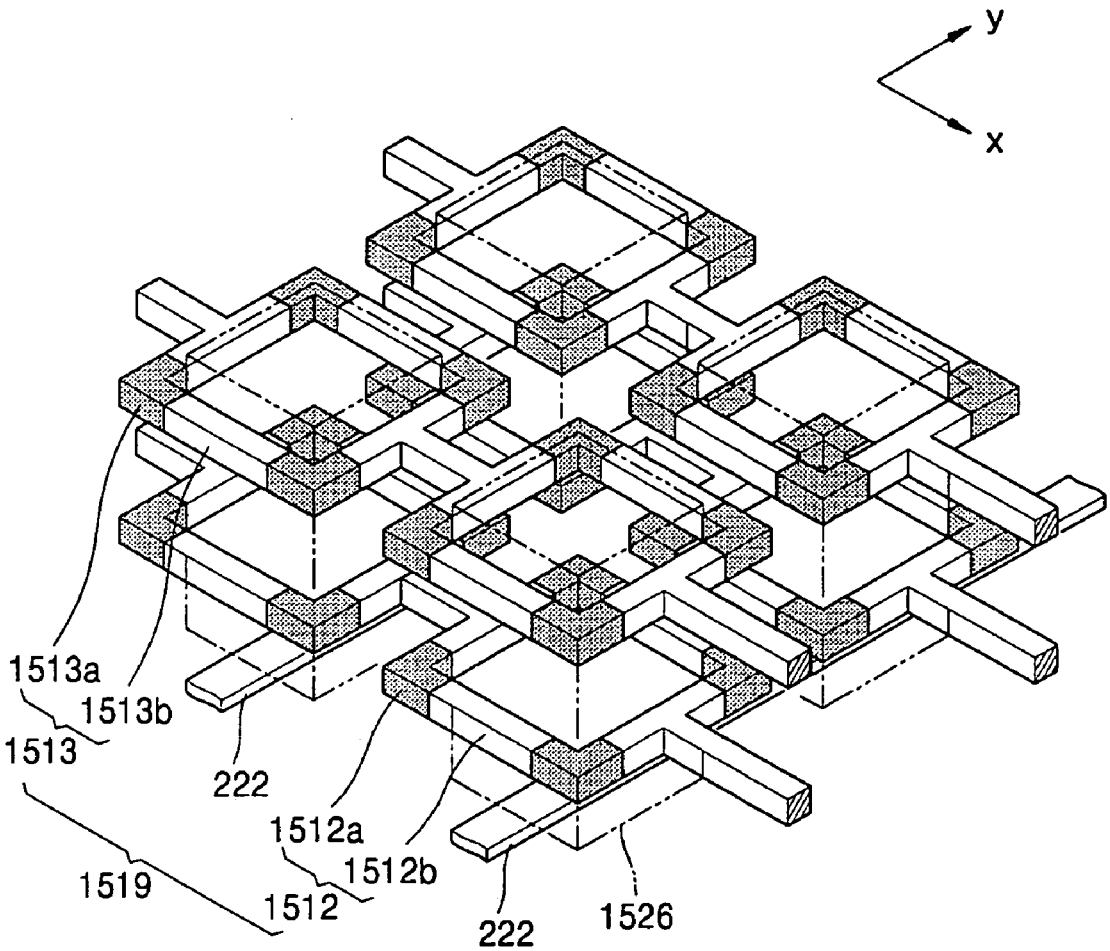
FIG. 27 is an exploded perspective view of discharge electrodes, discharge cells, and address electrodes of a second modified example of the PDP of FIG. 24.

FIG. 27 is an exploded perspective view of discharge electrodes 1519, discharge cells 1526, and address electrodes 222 of a second modified example of the PDP 1300 of FIG. 24. Referring to FIG. 27, the PDP is explained below based on the differences from the PDP 1300 of FIG. 24. In this case, barrier ribs comprise center barrier ribs and side barrier ribs (not shown), as in the PDP 600 of FIG. 12. To reduce the concentration of the discharge in corner portions of the discharge cells 1526, corner portions 1513*a* and 1512*a* of the discharge electrodes 1519 are made of a material having a higher resistivity than portions 1513*b* and 1512*b* of the discharge electrodes 1519 other than the corner portions 1513*a* and 1512*a*, as in the PDP 1300 of FIG. 24.

In addition to the modified examples, various modified examples of the PDP can be provided, for example, a PDP in which each of barrier ribs are formed in a integrated body and corner portions are made of a material having a higher resistivity.

Unlikely a conventional PDP in which pairs of sustain electrodes are not disposed in a front panel, in a PDP according to the present invention, discharge electrodes are disposed in barrier ribs to surround discharge cells and due to this characteristic structure, it is not necessary to dispose a dielectric layer or a protective layers, etc. on the front panel, through which visible light generated by fluorescent layers in the discharge cells is transmitted.

Thus, in the PDP according to the present invention, the visible light can be directly transmitted through a front substrate, thereby significantly increasing light transmittance.

Furthermore, since the pairs of sustain electrodes are formed on a rear surface of the front substrate in the conventional PDP, the majority of the sustain electrodes must be formed of ITO, which is highly resistive, in order to allow the generated visible light to be transmitted through the front substrate. Thus, a driving voltage of the conventional PDP increases and since the high resistance of the ITO electrodes causes a voltage drop, images cannot be uniformly displayed when the conventional PDP is large. However, since the discharge electrodes are disposed in the barrier ribs in the PDP according to the present invention, the discharge electrodes can be made of a highly conductive material, thereby overcoming the above problems.

In addition, in the conventional PDP, the pairs of sustain electrodes are formed on the rear surface of the front substrate, and the discharge occurs behind the protective layer in the discharge cells and diffuses within the discharge cells. Thus, luminous efficiency is reduced. When the conventional PDP is used for a long time, charged discharge gas induces ion sputtering of the fluorescent material in the fluorescent layers due to the electric field, thereby resulting in permanent after-images. However, in the PDP according to the present invention, the discharge uniformly occurs on inner sidewalls of the discharge cells and concentrates in the centers of the discharge cells, thereby increasing discharge efficiency and especially, the discharge is prevented from concentrating in the corner portions, thus increasing efficiency of the PDP.

As a result, the PDP according to the present invention can be driven at a low voltage and has an advantage of low production costs.

While the present invention has been particularly shown and described with reference to exemplary embodiments thereof, it will be understood by those of ordinary skill in the art that various modifications in form and detail can be made therein without departing from the spirit and scope of the present invention as defined by the following claims.

What is claimed is:

1. A Plasma Display Panel (PDP) comprising:

a front substrate and a rear substrate facing each other and separated from each other;

barrier ribs of a dielectric material arranged between the front substrate and the rear substrate to define discharge cells together with the front substrate and the rear substrate;

discharge electrodes arranged within the barrier ribs, the discharge electrodes being separated from each other and surrounding the discharge cells and each discharge electrode having at least one corner portion for surrounding the discharge cells;

fluorescent layers arranged in the discharge cells;

a discharge gas contained within the discharge cells; and an attenuator adapted to reduce a strength of an electric field generated between at least one pair of respective corner portions of a pair of discharge electrodes, the respective corner portions facing each other, to be less than a strength of an electric field generated between portions of the discharge electrodes facing each other, other than the respective corner portions, in the discharge cells;

wherein the attenuator comprises at least one pair of the facing corner portions of the discharge electrodes, a distance between the facing corner portions being greater than a distance between the portions of the facing discharge electrodes other than the corner portions in the discharge cells.

2. The PDP of claim 1, wherein the attenuator comprises the at least one pair of facing corner portions of the discharge electrodes, the facing corner portions being bent in a direction to be farther from each other than the portions of the facing discharge electrodes other than the corner portions.

3. The PDP of claim 1, wherein the discharge electrodes extend in parallel to each other and wherein address electrodes extend to cross the discharge electrodes.

4. The PDP of claim 1, further comprising address electrodes and a dielectric layer arranged on the rear substrate to cover the address electrodes.

5. The PDP of claim 1, wherein the discharge electrodes cross each other at a discharge cell.

6. The PDP of claim 1, wherein the discharge electrodes each have a ladder shape and at least a portion of each sidewall of the barrier ribs is coated with a protective layer.

7. The PDP of claim 1, wherein each of the barrier ribs has a central barrier rib portion and side barrier rib portions and each of the side barrier rib portions is coated with a protective layer.

8. The PDP of claim 1, wherein the barrier ribs comprise:

front barrier ribs formed on a rear surface of the front substrate and rear barrier ribs formed on a front surface of the rear substrate, the discharge electrodes being arranged in the front barrier ribs; and fluorescent layers arranged in a space defined by the rear barrier ribs and the rear substrate.

9. A Plasma Display Panel (PDP) comprising:

a front substrate and a rear substrate facing each other and separated from each other;

barrier ribs of a dielectric material arranged between the front substrate and the rear substrate to define discharge cells together with the front substrate and the rear substrate;

discharge electrodes arranged within the barrier ribs, the discharge electrodes being separated from each other and surrounding the discharge cells and each discharge electrode having at least one corner portion for surrounding the discharge cells;

fluorescent layers arranged in the discharge cells;

a discharge gas contained within the discharge cells; and an attenuator adapted to reduce a strength of an electric field generated between at least one pair of respective corner portions of a pair of discharge electrodes, the respective corner portions facing each other, to be less than a strength of an electric field generated between portions of the discharge electrodes facing each other, other than the respective corner portions, in the discharge cells;

wherein the attenuator comprises at least one pair of the facing corner portions of the discharge electrodes, a total thickness of the facing corner portions being less than a total thickness of the portions of the facing discharge electrodes other than the corner portions.

10. The PDP of claim 9, wherein the attenuator comprises at least one pair of the facing corner portions of the discharge electrodes having a concave portion on at least one of their facing surfaces.

11. The PDP of claim 9, wherein the attenuator comprises at least one pair of the facing corner portions of the discharge electrodes having a concave portion on at least one of the surfaces other than the facing surfaces.

12. A Plasma Display Panel (PDP) comprising:

a front substrate and a rear substrate facing each other and separated from each other;

barrier ribs of a dielectric material arranged between the front substrate and the rear substrate to define discharge cells together with the front substrate and the rear substrate;

discharge electrodes arranged within the barrier ribs, the discharge electrodes being separated from each other and surrounding the discharge cells and each discharge electrode having at least one corner portion for surrounding the discharge cells;

fluorescent layers arranged in the discharge cells;

a discharge gas contained within the discharge cells; and an attenuator adapted to reduce a strength of an electric field generated between at least one pair of respective corner portions of a pair of discharge electrodes, the respective corner portions facing each other, to be less than a strength of an electric field generated between portions of the discharge electrodes facing each other, other than the respective corner portions, in the discharge cells;

wherein the attenuator comprises at least one pair of the facing corner portions of the discharge electrodes, at least one corner portion having a higher resistivity than the portions of the discharge electrodes other than the corner portion.

* * * * *